US007513592B2

(12) United States Patent
Miyazawa

(10) Patent No.: US 7,513,592 B2
(45) Date of Patent: Apr. 7, 2009

(54) CLEANING DEVICE OF LIQUID JET APPARATUS, LIQUID JET APPARATUS, AND CLEANING METHOD

(75) Inventor: Hisashi Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 417 days.

(21) Appl. No.: 11/466,373

(22) Filed: Aug. 22, 2006

(65) Prior Publication Data

US 2007/0046721 A1 Mar. 1, 2007

(30) Foreign Application Priority Data

Aug. 24, 2005 (JP) ..... 2005-243201
Jun. 15, 2006 (JP) ..... 2006-166319

(51) Int. Cl.
*B41J 2/165* (2006.01)
*B41J 23/00* (2006.01)
*B41J 25/308* (2006.01)

(52) U.S. Cl. ..... 347/29; 347/30; 347/32; 347/33; 347/37; 347/8

(58) Field of Classification Search ..... 347/29, 347/30, 32, 33, 37, 8

See application file for complete search history.

(56) References Cited

U.S. PATENT DOCUMENTS

| | | | | |
|---|---|---|---|---|
| 5,500,659 | A * | 3/1996 | Curran et al. | 347/28 |
| 5,587,729 | A * | 12/1996 | Lee et al. | 347/32 |
| 6,081,282 | A * | 6/2000 | Saijo | 347/29 |
| 6,109,726 | A * | 8/2000 | Lee | 347/33 |
| 7,427,122 | B2 * | 9/2008 | Nakashima | 347/33 |

FOREIGN PATENT DOCUMENTS

| | | | |
|---|---|---|---|
| JP | 11-115275 | A | 4/1999 |
| JP | 2002-264350 | A | 9/2002 |
| JP | 2003-127434 | A | 5/2003 |

* cited by examiner

*Primary Examiner*—Shih-Wen Hsieh
(74) *Attorney, Agent, or Firm*—Workman Nydegger

(57) ABSTRACT

A cleaning device mounted on a liquid jet apparatus having a liquid jet head for ejecting liquid in order to clean the liquid jet head is provided. The cleaning device includes: a capping unit having a function of sealing a nozzle forming surface of the liquid jet head and a function of receiving waste liquid discharged from the liquid jet head; a lifting unit raising and lowering the capping unit so as to attach and detach the capping unit to and from the liquid jet head; an urging unit urging the capping unit toward the liquid jet head; and a locking unit locking the urging unit in a state that the capping unit makes contact with the liquid jet head and seals the nozzle forming surface.

13 Claims, 9 Drawing Sheets

CLEANING DEVICE OF LIQUID JET APPARATUS, LIQUID JET APPARATUS, AND CLEANING METHOD

BACKGROUND

1. Technical Field

The present invention relates to a cleaning device of a liquid jet apparatus, a liquid jet apparatus, and a cleaning method.

2. Related Art

An ink jet recording apparatus is widely known as an example of liquid jet apparatuses. The ink jet recording apparatus includes a recording head ejecting (discharging) ink droplets (liquid) so as to perform recording (printing) and the thickness of the recording medium used such as sheets of paper to be recorded (printed) varies depending on the purposes the recording medium. The liquid droplets are ejected onto the recording medium from a recording head that moves across the recording medium. Therefore, as the thickness of the used recording medium is changed, the gap between the recording head and the surface of the recording medium is changed accordingly and the landing positions of the liquid droplets are displaced, thereby deteriorating printing accuracy. JP-A-11-115275 and JP-A-2002-264350 disclose a recording apparatus including a platen gap adjusting device which suitably adjusts the gap (platen gap) between the recording head and a platen (a sheet guiding member) by moving the recording head in a vertical direction depending on the thickness of the recording medium.

The ink jet recording apparatus includes a cleaning device which performs a wiping function of wiping the nozzle forming surface (a surface having nozzle orifices) of a liquid jet head and removing dirty ink, a flushing function of flushing out the ink clogged in the nozzles by means of an idle discharging operation, and a sucking function of forcibly sucking the ink from the nozzles so as to prevent the ink clogged in the nozzles (see JP-A-11-115275, JP-A-2002-264350, and JP-A-2003-127434). The cleaning device includes a strip-like wiping member formed of an elastic material and a capping unit which covers the nozzle forming surface of the recording head in order to prevent the nozzles from drying. When a sucking operation is performed, the capping unit covers the nozzle forming surface so as to seal the nozzle forming surface and a suction pump applies a negative pressure to a sealed space, thereby forcibly discharging the liquid from the nozzles of the recording head. The sucking operation is generally followed by a wiping operation of removing the liquid attached to the nozzle forming surface and rearranging liquid meniscuses formed at the nozzle orifices.

However, when the position of the recording head is adjusted in a vertical direction using the platen gap adjusting device, the gap between the vertical position of the recording head and vertical positions where the capping unit and the wiping member are positioned at the time of cleaning varies accordingly. As the gap varies, the contact degree (the amount of interference) of the wiping member with respect to the nozzle forming surface of the recording head changes accordingly. As a result, the operation of wiping the nozzle forming surface fails or the ink is scattered into the recording apparatus when the elastically deformed wiping member recovers its original shape by an elastic recovery force, thereby contaminating the recording apparatus.

In order to solve the above-mentioned problems, JP-A-11-115275 discloses a technology in which at a cleaning period, the wiping member is automatically adjusted by the platen gap adjustment device so as to obtain a platen gap different from that of a printing period and a predetermined amount of interference with respect to the nozzle forming surface.

JP-A-2002-264350 discloses an ink jet recording apparatus in which the amount of interference between the wiping member and the recording head varies depending on the size of the platen gap and the speed or the number of wipings is changed depending on the size of the platen gap when the wiping performance deteriorates due to the interference, thereby performing a desirable cleaning operation JP-A-2003-127434 discloses a cleaning device in which the capping unit and the wiping member are integrated so as to rise and fall as a single member. In this case, since the amount of interference between the wiping member and the recording head also varies in accordance with the adjustment of the platen gap, it is possible to suitably adjust the amount of interference between the wiping member and the recording head by utilizing the arrangement disclosed in JP-A-11-115275 or to suitably perform the cleaning operation of the wiping member by utilizing the method disclosed in JP-A-2002-264350.

In JP-A-2002-264350, since the amount of interference between the wiping member and the recording head varies depending on the size of the platen gap, the cleaning performance can be enhanced by modifying the speed or the number of wipings. However, as the size of the platen gap varies, the distance between the capping unit and the recording head as well as the amount of interference may vary. For example, when a thick sheet is used for printing and the recording head is positioned at a relatively high position in order to obtain a wide platen gap, the gap between the recording head and the capping unit widens when a flushing operation is performed. When the gap between the recording head and the capping unit widens and the distance from the nozzles to the capping unit at which the liquid droplets discharged from the nozzles are dropped increases, the liquid droplets discharged from the nozzles are likely to become mist and freely fly into the recording apparatus, thereby contaminating the recording apparatus. This problem may also arise in the cleaning device disclosed in JP-A-2003-127434 in which the capping unit and the wiping member are integrated into a single member.

In addition, in JP-A-11-115275, since the platen gap is automatically adjusted, the wiping member has a predetermined contact degree (the amount of interference) with respect to the nozzle forming surface during the cleaning operation. However, the platen gap needs to be changed to a platen gap different from that of the printing operation for every wiping period, thereby decreasing the throughput of the printing device. A method of changing the platen gap every cleaning period may be applied to the flushing operation. Like the case of the wiping period, the platen gap needs to be changed to a platen gap different from that of the printing operation for every flushing period, thereby decreasing the throughput of the printing device. In addition, the method of changing the platen gap every cleaning period cannot be applied to the recording apparatus disclosed in JP-A-2003-127434 which includes a platen gap adjusting device that is manually operated.

SUMMARY

An advantage of some aspects of the invention is that it is to provide a cleaning device of a liquid jet apparatus, a liquid jet apparatus, and a cleaning method, capable of suppressing generation of mist in a flushing operation without deteriorating throughputs of the liquid jet apparatus.

According to an aspect of the invention, there is provided a cleaning device mounted on a liquid jet apparatus having a liquid jet head for ejecting liquid in order to clean the liquid jet head, the cleaning device including: a capping unit having a function of sealing a nozzle forming surface of the liquid jet head and a function of receiving waste liquid discharged from the liquid jet head; a lifting unit raising and lowering the capping unit so as to attach and detach the capping unit to and from the liquid jet head; an urging unit urging the capping unit toward the liquid jet head; and a locking unit locking the urging unit in a state that the capping unit makes contact with the liquid jet head and seals the nozzle forming surface. In the cleaning device described above, the liquid may be any liquid that can be applied to the liquid jet (ink-jet) method. For example, the liquid is not limited to ink used for recording (or printing), but may include a liquid material containing a material having a particular function, which is ejected from a liquid jet head in a diffused or dissolved state when at least part of elements (such as wires, components, and pixels) of an electronic circuit board are manufactured at least partially using the ink jet method.

First, the idle discharging (flushing) for discharging liquid (waste liquid) from the liquid jet head for the cleaning operation is performed on the capping unit opposed to the liquid jet head with a gap (distance) therebetween. The gap may be changed when a gap adjusting unit equipped in the liquid jet apparatus adjusts the position of the liquid jet head in the gap direction or when the attaching position of the liquid jet head and the cleaning device is changed in the gap direction. As the gap widens, the liquid droplets discharged in the flushing operation are likely to become mist. When a gap adjusting unit is incorporated in the liquid jet apparatus equipped with the cleaning device of the invention, the position of the liquid jet head with respect to a medium placing surface is adjusted depending on the thickness of the medium (recording medium or substrate). In this case, the medium placing surface is the surface of a gap defining member (platen or table) which defines the gap between the liquid jet head and the medium. In this manner, when the invention is applied to a liquid jet apparatus having the gap adjusting unit, since the position of the liquid jet head is adjusted depending on the thickness of the medium, the positional relationship between the liquid jet head and the cleaning device (i.e., capping unit) is changed accordingly.

When the capping unit is at a sealing position while being raised by the lifting unit so as to make contact with the liquid jet head, since the capping unit is urged toward the liquid jet head by the urging unit, the liquid jet head is securely sealed. In the sealing state, the urging unit is locked by the lock unit. When the capping unit is lowered, since the urging unit is locked by the urging unit, the distance between the lowered capping unit and the liquid jet head is maintained approximately constant regardless of, the gap between the liquid jet head and the medium placing surface. For example, in the known cleaning device in which the distance may vary, when the liquid jet head is at a position nearest to the medium placing surface, it is necessary to set the distance between the lowered capping unit and the liquid jet head in order to prevent the capping unit from making contact with the liquid jet head. In this case, when the liquid jet head is at a position farthest from the medium placing surface, the distance between the lowered capping unit and the liquid jet head increases and the discharged liquid droplets are likely to become mist. To the contrary, in the cleaning device according to the invention, since the distance between the lowered capping unit and the liquid jet head is approximately constant, it is possible to set the approximately constant distance to a distance within a predetermined range in which the discharged liquid droplets are unlikely to become mist. As a result, at the time of the idle discharging (flushing) for discharging liquid (waste liquid) from the liquid jet head for the cleaning operation, since the distance between the liquid jet head and the capping unit is not increased, the discharged liquid droplets are unlikely to become mist and contamination due to the mist in the liquid jet apparatus is efficiently prevented. In addition, unlike the known cleaning device, it is unnecessary to operate the gap adjusting unit in the wiping operation. Therefore, it is possible to suppress the generation of the mist in the flushing operation without decreasing the throughput of the printing device.

In addition, due to irregularity of attaching position of the liquid jet head, the distance between the liquid jet head and the capping unit may vary. Even in this case, since the urging unit is locked in a state that the capping unit makes contact with the liquid jet head and seals the nozzle forming surface, it is possible to maintain the distance between the liquid jet head and the capping unit during the subsequent flushing operation at an approximately constant value. Therefore, when the distance between the liquid jet head and the capping unit may vary due to the irregularity of attaching position of the liquid jet head, it is possible to suppress the generation of mist in a flushing operation in a similar manner to the case of the liquid jet apparatus having the gap adjusting unit.

In addition, a time point of locking the urging unit may be any time point on condition that the capping unit is in a sealing state where the capping unit makes contact with the liquid jet head and seals. The locking time point is not limited to the time point when the lifting unit is at the uppermost capping position, but an intermediate time point during the lowering operation before the capping unit is separated from the liquid jet head may be selected as the locking time point. Examples of the sealing function performed by the capping unit include a function of capping the nozzle forming surface in order to prevent the liquid in nozzles of the liquid jet head from drying and a function of capping the nozzle forming surface in order to suck the liquid from the nozzles of the liquid jet head. The sealing of the capping unit does not need to seal the whole jet ports of the liquid jet head but needs to seal at least the jet ports (nozzle orifices) of the liquid jet head that discharges inks.

In the cleaning device according to the invention, the lifting unit lowers the capping unit to unseal the liquid jet head in a state in which the urging unit remains locked by the locking unit.

In the cleaning device described above, even when the capping unit is lowered and the liquid jet head is released from its sealing state, it is possible to maintain the distance between the lowered capping unit and the liquid jet head at an approximately constant distance regardless of the gap between the liquid jet head and the medium placing surface.

In the cleaning device according to the invention, the lowering amount of the capping unit is set to a preset value.

In the cleaning device described above, it is possible to suppress the generation of the mist in the flushing operation by setting the approximately constant distance between the liquid jet head and the medium placing surface to a distance within a predetermined range in which the discharged liquid droplets are unlikely to become mist, regardless of the gap between the liquid jet head and the medium placing surface. In addition, when the distance between the liquid jet head and the medium placing surface is set to a predetermined distance so as to allow the gap between the liquid jet head and the medium placing surface, it is possible to minimize the moving distance of the capping unit and downsize the cap unit.

In the cleaning device according to the invention, the cleaning device may further include a head contact unit having a wiping member wiping the capping unit and the nozzle forming surface of the liquid jet head, the lifting unit raises and lowers the head contact unit so as to attach and detach the capping unit to and from the liquid jet head, and the lifting unit lowers by a lowering amount the head contact unit from a sealing position where the capping unit seals the nozzle forming surface to a wiping position where the wiping member wipes the nozzle forming surface, in a state in which the urging unit remains locked by the locking unit.

In the cleaning device described above, the head contact unit is lowered from a position where the capping unit seals the nozzle forming surface to a wiping position. In this case, when the head contact unit is lowered to the wiping position, since the urging unit is locked and the locking position of the urging unit is changed depending on the gap between the liquid jet head and the medium placing surface, the amount of interference between the wiping member and the nozzle forming surface is maintained approximately constant. Therefore, at the time of the wiping operation, since the amount of interference between the wiping member and the nozzle forming surface is maintained approximately constant regardless of the gap between the liquid jet head and the medium placing surface, the wiping operation is efficiently performed. In addition, unlike the known cleaning device, it is unnecessary to operate the gap adjusting unit in the wiping operation. Therefore, it is possible to perform the wiping operation without decreasing the throughput of the printing device.

In the cleaning device according to the invention, the lowering amount of the head contact unit is set to a preset value in order to restrict the amount of interference between the wiping member and the nozzle forming surface at the time of wiping the nozzle forming surface to a suitably constant value.

In the cleaning device described above, since the amount of interference between the wiping member and the nozzle forming surface is maintained approximately constant regardless of the gap between the liquid jet head and the medium placing surface, the wiping operation is efficiently performed.

In the cleaning device according to the invention, it is desirable that the cleaning device may further include a suction unit applying a negative pressure to a space where the capping unit makes contact with and seals the liquid jet head and sucking the liquid from nozzles of the liquid jet head, and the locking unit unlocks the urging unit when the suction unit sucks the liquid from the liquid jet head.

In the cleaning device described above, since the urging unit is unlocked during the sucking operation, the sucking operation is efficiently performed. For example, the sucking operation is performed in a state that the urging unit is locked, the sealing of the capping unit may be failed due to the vibration generated during the sucking operation and the sucking operation may be performed inefficiently. However, since the urging unit is unlocked, the urging unit is expanded by the vibration generated during the sucking operation and a secure sealing operation is performed by the capping unit. Therefore, it is likely to efficiently perform the sucking operation.

In the cleaning device according to the invention, it is desirable that when the liquid jet head is idling without ejecting the liquid, the lifting unit raises the capping unit and the lifting unit caps the nozzle forming surface by making contact with and sealing the nozzle forming surface in order to prevent the liquid in nozzles of the liquid jet head from drying and the locking unit unlocks the urging unit when the nozzle forming surface is capped by the capping unit.

In the cleaning device described above, when the liquid jet head is idling without ejecting the liquid, the sealing operation (capping operation) is performed by the capping unit in order to prevent the liquid in the nozzles of the liquid jet head from drying. During the capping operation, since the urging unit is unlocked, the capping operation is efficiently performed.

In the cleaning device according to the invention, it is desirable that the locking unit unlocks the urging unit before the lifting unit raises the capping unit and makes contact with the liquid jet head.

In the cleaning device described above, since during the capping operation, the urging unit is unlocked before the capping unit is raised to make contact with the liquid jet head, the liquid jet head is securely capped by the urging force of the urging unit when the capping unit makes contact with the liquid jet head. For example, even when the capping unit is at a low position and the gap adjusting unit shortens the gap between the liquid jet head and the medium placing surface, it is possible to prevent the capping unit in which the urging unit is locked in response to the gap adjustment from colliding strongly with the liquid jet head.

In this case, it is desirable that the lock unit unlocks the urging unit before the lifting unit starts to raise the capping unit until the capping unit makes contact with the liquid jet head. By unlocking the urging unit before the lifting unit starts to raise the capping unit, even when the unlocking of the urging unit is delayed due to irregularity of the unlocking time point, it is easy to prevent the capping unit from colliding with the nozzle forming surface.

In the cleaning device according to the invention, it is desirable that the locking unit unlocks the urging unit for a capping period when the lifting unit raises the capping unit. In the present embodiment, the capping period may include any one of an execution period of a capping (sealing) function of preventing the liquid in the nozzles from drying and an execution period of a capping (sealing) function of sucking the liquid from the nozzles.

In the cleaning device described above, when the capping unit is lowered from the sealing state, the locked urging unit is unlocked at the next capping period. Therefore, during a time period from the capping release period to the next capping period, since a suitable gap is maintained between the nozzle forming surface and the capping unit by only performing the flushing operation as usual, the liquid droplets discharged in the flushing operation are unlikely to become mist.

In the cleaning device according to the invention, it is desirable that when the liquid jet head ejects the liquid onto a medium, the urging unit is locked by the locking unit, the liquid jet head performs a flushing operation in a state that the liquid jet head faces the capping unit for a flushing period in the course of ejecting the liquid, and the locking unit still locks the urging unit during the flushing operation.

In the cleaning device described above, when the liquid is ejected onto the medium (for example, if the medium is a print medium, the print medium is printed), the urging unit is in a locked state. Thereafter, at least one of the liquid jet head and the capping unit moves toward to face each other and a flushing operation, in which the liquid is discharged (idle discharging) from the liquid jet head, is performed at a flushing period. In the flushing operation, since the distance between the nozzle forming surface of the liquid jet head and the capping unit are set to a distance within a predetermined range without being greatly separated from each other, the liquid droplets discharged in the flushing operation are unlikely to become mist. Therefore, since the capping unit does not need to redundantly perform the capping operation in order to make contact with the nozzle forming surface every flushing period, it is possible to efficiently perform the capping operation.

In the cleaning device according to the invention, it is desirable that the liquid jet apparatus includes a gap control unit which moves the liquid jet head in order to control a gap between the liquid jet head and a surface of a medium having the liquid from the liquid jet head deposited thereon, and the cleaning device is mounted on the liquid jet apparatus. In addition, the medium is not limited to a recording medium (print medium) on which the printing is performed, but may include a substrate on which a liquid, material having a particular function is ejected when at least part of elements (such as wires, components, and pixels) of an electronic circuit board are manufactured at least partially using the ink jet method.

In the cleaning device described above, since the gap between the liquid jet head and the medium placing surface is adjusted by the gap adjusting unit, the gap between the liquid jet head and the medium placing surface is suitably maintained regardless of the thickness of the medium (on which the liquid is ejected). Even when the position of the liquid jet head is changed by the gap adjusting unit, since the urging unit is locked in advance, the distance between the lowered capping unit and the liquid jet head is maintained at an approximately constant distance regardless of the gap between the liquid jet head and the medium placing surface. In addition, by setting the approximately constant distance to a distance within a predetermined range in which the discharged liquid droplets are unlikely to become mist, it is possible to prevent the liquid droplets discharged in the idle discharging (flushing) operation from becoming mist, thereby preventing contamination due to the mist in the liquid jet apparatus. In addition, unlike the known cleaning device, it is unnecessary to operate the gap adjusting unit in the wiping operation. Therefore, it is possible to suppress the generation of the mist in the flushing operation without decreasing the throughput of the printing device.

According to another aspect of the invention, there is provided a liquid jet apparatus including the liquid jet head for ejecting liquid and the cleaning device according to the above-mentioned aspect of the invention.

In the liquid jet apparatus described above, it is possible to provide a liquid jet apparatus capable of suppressing generation of mist in a flushing operation without deteriorating throughputs of the liquid jet apparatus. In addition, it is possible to provide a liquid jet apparatus capable of efficiently performing the wiping operation without deteriorating throughputs of the liquid jet apparatus.

According to another aspect of the invention, there is provided a cleaning method of a liquid jet apparatus in which a capping unit makes contact with and seals a nozzle forming surface in order to prevent liquid in nozzles of a liquid jet head for ejecting the liquid from drying and the capping unit opposed to the nozzle forming surface with a gap therebetween receives waste liquid discharged from the nozzles of the liquid jet head, the method including: sealing the nozzle forming surface by raising the capping unit to make contact with the liquid jet head in order to prevent the liquid in the nozzles of the liquid jet head for ejecting liquid from drying; locking a urging unit, which urges the capping unit in a sealing state toward the liquid jet head, in a state that the capping unit makes contact with the liquid jet head and seals the nozzle forming surface; lowering the capping unit from a position where the capping unit makes contact with the liquid jet head to a flushing position where the capping unit receives the waste liquid discharged from the liquid jet head; and flushing the waste liquid out of the liquid jet head toward the capping unit at the flushing position.

In the cleaning method of a liquid jet apparatus described above, since it is possible to set the distance between the nozzle forming surface and the capping unit to a distance within a predetermined range during the flushing operation, the liquid (waste liquid) discharged in the flushing operation are unlikely to become mist. Therefore, it is possible to suppress the generation of the mist in the flushing operation without decreasing the throughput of the printing device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to FIGS. 1 to 13.

Figure 1:
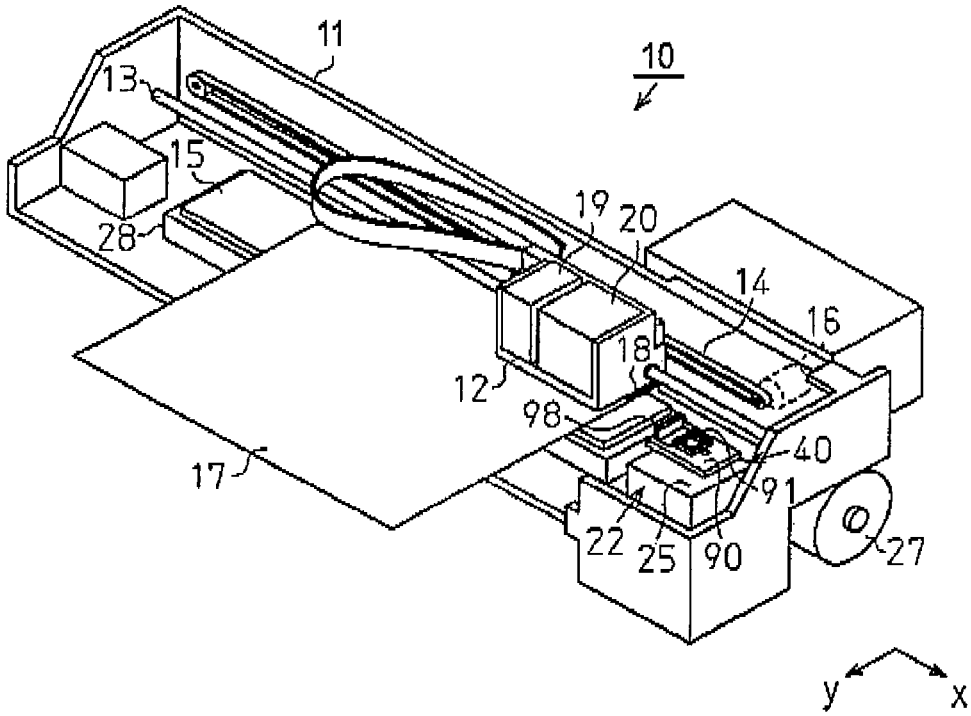
FIG. 1 is a schematic view of a recording apparatus according to an embodiment of the invention.

FIG. 1 is a schematic view showing a basic arrangement of an ink jet recording apparatus according to an embodiment of the invention. As illustrated in FIG. 1, the ink jet recording apparatus (hereinafter will be referred to as a recording apparatus 10) serving as a liquid jet apparatus includes a base body 11 (a main frame) and a carriage 12 reciprocatively movable in the base body 11. An elongated guide shaft 13 is disposed so as to have both ends thereof fixed to inner surfaces of left and right sidewalls of the base body 11 and the carriage 12 is guided by the guide shaft 13 inserted into an inserting hole 12*a* thereof and is fixed to a portion of a timing belt 14. Therefore, when a carriage motor 16 is activated, the timing belt 14 is driven and as a result, the carriage 12 moves reciprocatively in a main scan direction (x-direction in the figure) parallel to the length direction of a platen 15 by the timing belt 14.

An ink jet recording head to be described later (hereinafter will be referred to as a recording head 18) serving as a liquid jet head is mounted on a surface (a lower surface) of the carriage 12 which faces a recording sheet (medium or a recording medium) 17. A nozzle forming surface 18*a* (see FIGS. 7 to 9) faces the recording sheet 17 with a small gap therebetween. A black ink cartridge 19 supplying ink as liquid to the recording head 18 and color ink cartridges 20 containing three color inks, for example, yellow, cyan, and magenta, respectively, are detachably loaded to an upper part of the carriage 12. In the present embodiment, the inks are supplied from the ink cartridges 19 and 20 to the recording head 18. A plurality array of nozzle orifices (not shown) is formed on the nozzle forming surface 18*a* of the recording head 18 and the inks are discharged from the nozzle orifices.

A cap unit 40 (a maintenance unit) constituting a cleaning device is disposed in a non-printing area (a home position 22) of the base body 11 which is positioned at one end of the travel path of the carriage 12. When the recording head 18 mounted on the carriage 12 moves to a position directly above the cap unit 40, the cap unit 40 raises a cap part 91 serving as capping means and a wiping member 98. Accordingly, the cap part 91 serving as the capping means seals the nozzle forming surface 18*a* of the recording head 18. A suction pump 25 for applying a negative pressure to the inner space of the cap part 91 is disposed at a location adjacent to the cap unit 40. The suction pump 25 is a tube pump in the present embodiment and includes a rotator performing rotation using a driving force supplied from a sheet conveying motor 27 which drives rollers (not shown) for conveying and discharging the recording sheet 17 via a train of reduction gears, a cylindrical body accommodating the rotator, and a flexible tube wound around portions of the outer circumference of the rotator. In the suction pump 25, as the rotator rotates, a plurality of rollers (pressing parts) fixed to the circumference of the rotator pull (pressingly move) the tube in one direction thereby pushing out air in the tube and generating a negative pressure in an upstream space of the tube. One end of the suction side of the tube is connected to a connecting pipe of a cap head 90 of the cap unit 40 and the other end of the discharging side of the tube is connected to a waste liquid tank 28 located below the platen 15. The suction pump 25 changes to a release state when the rotator rotates in a direction opposite to a direction in which the rotator activates a pumping operation.

The cap part 91 has a rectangular shape and serves not only as a lid (a capping function) for preventing the nozzle orifices of the recording head 18 from drying in an idle period of the recording apparatus 10, but also as a part of a cleaning device for generating a sealed space in which the negative pressure from the suction pump 25 is applied to the recording head 18, and for sucking and discharging ink from and to the recording head 18. In addition, when ink is discharged from the recording head 18 at a position adjacent to the home position 22 in accordance with a drive signal not serving as print data and air or ink clogged in the nozzles is sucked, i.e., when an idle discharging (flushing) operation is performed, the cap part 91 serves as a tray for receiving liquid droplets discharged from the recording head 18 by the flushing operation.

In the cap head 90, a rectangular wiping member 98 formed of a rubber material is disposed at a printing area side adjacent to the cap part 91 so as to protrude therefrom and the wiping member 98 wipes the nozzle forming surface 18*a* when the carriage 12 moves from the home position 22 side to the printing area side after the sucking operation of the recording head 17 is completed. According to such an arrangement, it is possible to wipe out ink attached to the nozzle forming surface 18*a* after the cleaning operation (sucking operation) by the use of the wiping member 98.

Platen Gap Adjusting Mechanism

Figure 2:
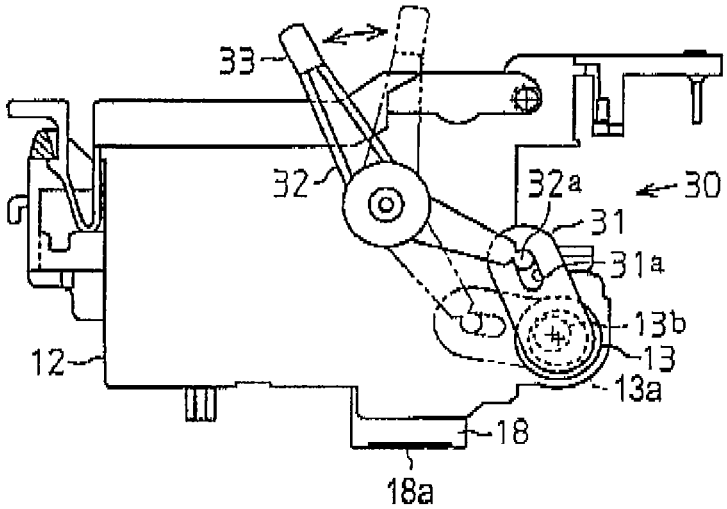
FIG. 2 is a side view of a platen gap adjusting mechanism according to an embodiment of the invention; A

The recording apparatus 10 according the present embodiment includes a platen gap adjusting mechanism capable of adjusting a platen gap between the recording head 18 and the platen 15 in accordance with the thickness of the recording sheet 17. FIG. 2 illustrates an arrangement of the platen gap adjusting mechanism. The platen gap adjusting mechanism 30 illustrated in the figure is implemented as a mechanism capable of manually adjusting the position of an operation member 33 in accordance with the thickness of a sheet thereby positioning the carriage 12 to a vertical position that corresponds to a suitable platen gap for the sheet thickness. The structure of the mechanism will be described hereinafter. First, the carriage 12 is guided by the guide shaft 13 formed of a cylindrical pipe in a direction perpendicular to the paper surface of FIG. 2, and an intermediate shaft 13*a* is rotatably disposed in the guide shaft 13. The intermediate shaft 13*a* is supported by an eccentric shaft 13*b* pivotally supported by right and left sidewalls constituting the base body 11 at both ends in the axial direction thereof. An actuating lever 31 having a sliding groove 31*a* is coupled to the intermediate shaft 13*a*. A sliding member 32*a* disposed at a portion actuated by the operation lever 32 pivotally supported on the base body 11 is slidably inserted into the sliding groove 31*a* formed in the actuating lever 31.

The operation lever 32 has an end portion of its operating side fixed to the operation member 33 capable of rotating the operation lever 32. When the operation lever 32 is moved by the operation member 33 in the directions of the arrows shown in FIG. 2, the carriage 12 having the recording head 18 mounted thereon is moved in a vertical direction. More specifically, in the present embodiment, when the operation lever 32 is pulled forward (rotates counterclockwise in FIG. 2) as indicated by solid lines, the actuating lever 31 rotates clockwise in the figure. Accordingly, the carriage 12 is slightly lowered by the action of the eccentric shaft 13*b*. As a result, the recording head 18 moves downward and the gap (platen gap) between the recording head 18 and the platen 15 as illustrated in FIG. 1 is reduced.

On the other hand, when the operation lever 32 is standing as indicated by chain lines, the actuating lever 31 is rotated counterclockwise in the figure. Accordingly, the carriage 12 is raised by the action of the eccentric shaft 13*b*. As a result, the recording head 18 moves upward and the gap between the recording head 18 and the platen 15 as illustrated in FIG. 1 is increased.

Although the platen gap adjusting mechanism 30 that operates manually is used in the present embodiment, an automatic platen gap adjusting mechanism that is capable of automatically adjusting the platen gap may be used. An example of the automatic platen gap adjusting mechanism is an automatic adjusting mechanism in which a suitable platen gap corresponding to the thickness of each kind of recording media (recording sheet) input through an input device of a host computer from a user is determined with reference to a data table recorded in advance in a memory, thereby driving the driving units including a motor to have the determined platen gap. For example, the platen gap adjusting mechanism disclosed in JP-A-11-115275 corresponds to the automatic adjusting mechanism above. In addition, another example of the automatic platen gap adjusting mechanism is an automatic adjusting mechanism in which the distance between a recording head and a platen and the distance between the recording head and a recording medium (sheet) are measured, the thickness of the recording medium is calculated from the difference between the two distances measured, and thereby driving the driving units to have a suitable platen gap in accordance with the calculated thickness. In the present embodiment, examples of a method of measuring the distance between the recording head and a recording medium include a method in which the distance is measured using a measuring instrument such as an end-measuring machine by the use of a laser and a method in which the recording head is lowered from a reference position until the recording head makes contact with a platen and a recording medium, the lowering amounts for the platen and the recording medium are calculated on the basis of the number of motor rotations (step number) performed, and thereby obtaining the thickness ;of the recording medium on the basis of the difference between the two lowering amounts.

Structure of Cap Unit

Figure 3:
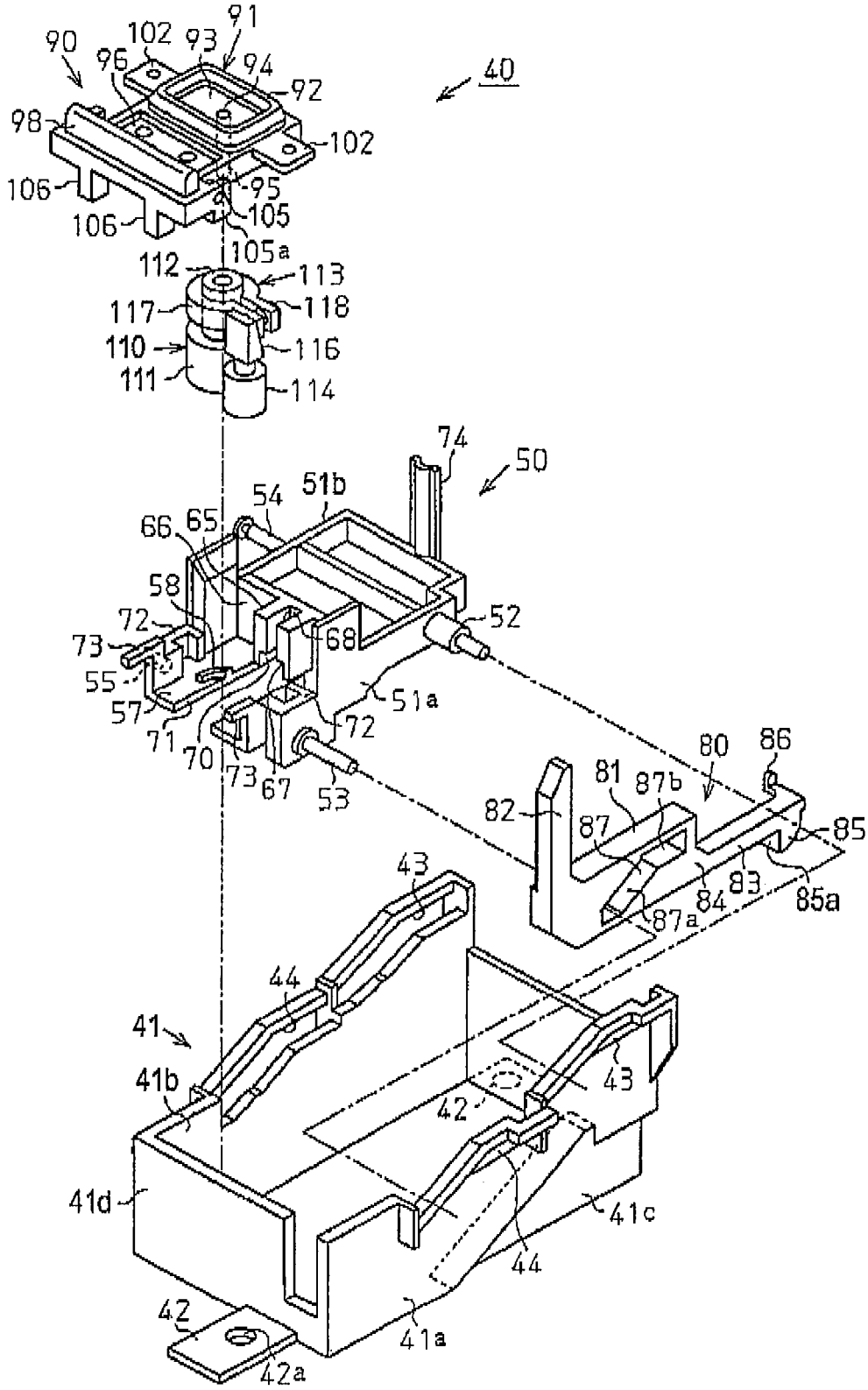
FIG. 3 is an exploded schematic view of a cap unit according to an embodiment of the invention.
Figure 4:
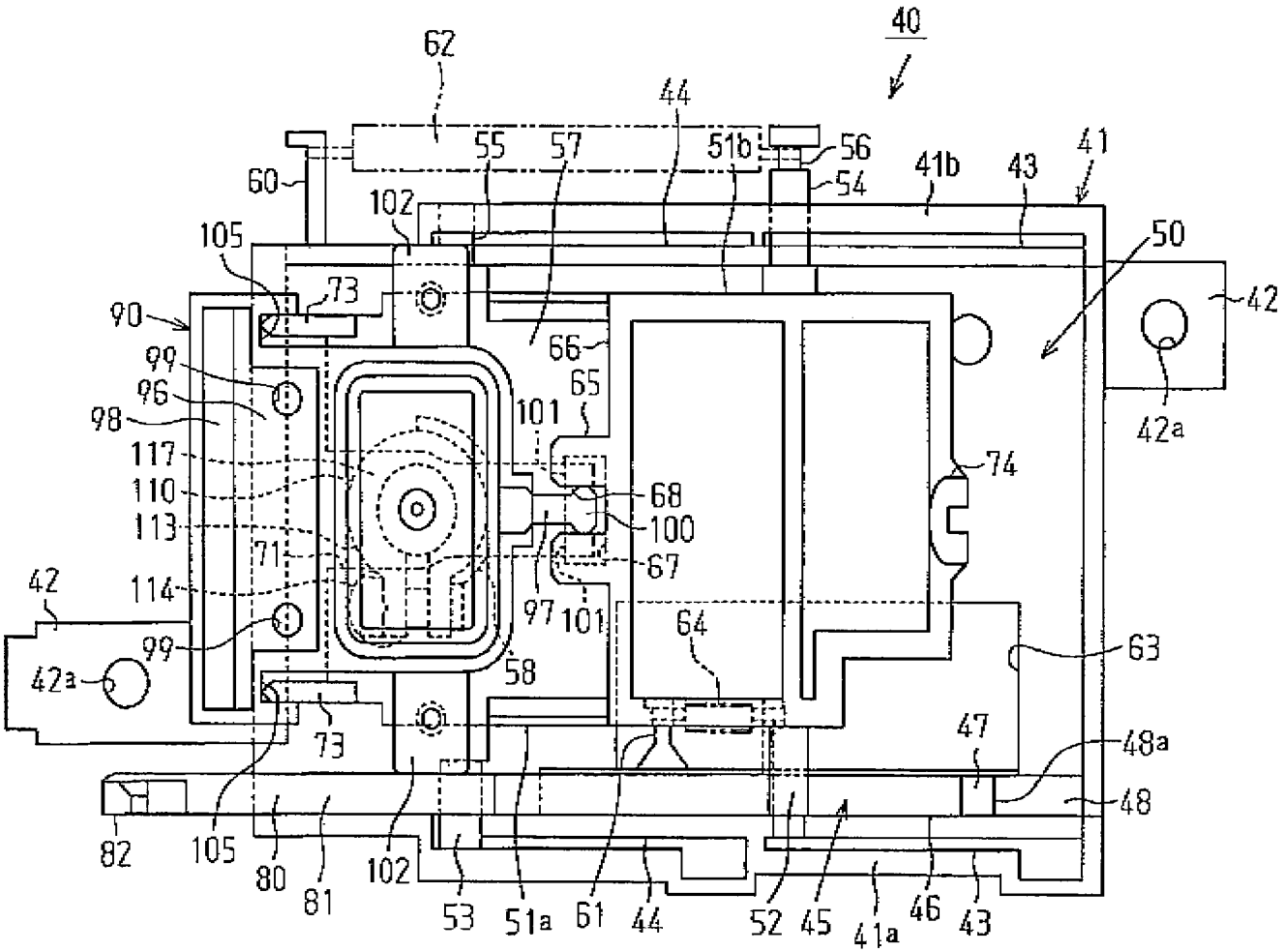
FIG. 4 is a plan view of the cap unit.

Next, a structure of the cap unit 40 employed in the recording apparatus 10 described above will be described with reference to FIGS. 3 to 9. FIG. 3 is an exploded schematic view of the cap unit and FIG. 4 is a plan view of the cap unit. Although not illustrated in the figure, the suction pump 25 and the train of reduction gears (not shown) for transferring the driving force from the sheet conveying motor 27 to the suction pump 25 are integrated as a single unit into the cap unit 40. The cap unit 40 is fixed to the suction pump 25 disposed on the inner surfaces of one of the left and right sidewalls of the base body 11 so as to cover the suction pump 25. In addition, the flexible tube connected to the connecting pipe of the cap head 90 constituting the cap unit 40 to form a part of the suction pump 25 is omitted in the figure.

The cap unit 40 includes a cap frame 41 as a base material thereof and the cap frame 41 is fixed to the base body 11 through a fixing part 42. Accordingly, the cap unit 40 is located at a position corresponding to the home position 22 which is positioned at the inner surface of the one end of the base body 11. In addition, a hole portion 42*a* is formed in the fixing part 42 and a screw inserted into the hole portion 42*a* is threaded into a screw hole formed in the base body 11, thereby fixing the cap frame 41 to the base body 11.

The cap frame 41 includes sidewalls 41*a* and 41*b* having a slope as illustrated in FIG. 3 and FIGS. 7 to 9 and a top portion of the slope is located at the inner surface of the one end of the base body 11 (right side in FIG. 1). A pair of guide holes (first guide holes 43 and second guide holes 44) are formed in the sidewalls 41*a* and 41*b*. The guide holes 43 and 44 extend along the slope in a moving direction of the recording head 18 (a length direction of the cap frame 41).

The first guide holes 43 are positioned at the top portion of the sidewalls 41*a* and 41*b* (at the one end of the base body 11). The first guide holes 43 include a lower end portion 43*a* with parallel sides, an inclined portion 43*b*, and an upper end portion 43*c* with parallel sides, which are successively formed in this order. The second guide holes 44 include a lower end portion 44*a* with parallel sides, a first inclined portion 44*b*, an intermediate portion 44*c* with parallel sides, a second inclined portion 44*d*, and an upper end portion 44*e* with parallel sides, which are successively formed in this order. In addition, the sidewalls 41*a* and 41*b* have the same profiles as the guide holes 43 and 44, respectively. Therefore, the upper end portions 43*c* and 44*e* are positioned at the top portion of the slope of the sidewalls 41*a* and 41*b*, respectively. Thus, the guide holes 43 and 44 constitute a cam mechanism.

In the cap frame 41, a recess part 41*c* protruding into the inside of the cap frame 41 as well as being recessed from the outside of the cap frame 41 is formed on the sidewall 41*a* as shown in the lower-right side of FIG. 3. Accordingly, a guide slope 45 is formed in the inner surface of the sidewall 41*a* of the cap frame 41. The guide slope 45 includes a slope portion 46 which slopes downward from a front side (right side in FIG. 3) and slopes upward from a rear side (left side in FIG. 3).

In the guide slope 45, a flat top portion 47 having a predetermined length is disposed at the top portion of the slope portion 46 and a claw-engaging concave part 48 is disposed next to the top portion 47. The claw-engaging concave part 48 corresponds to an indented portion engaging with a locking claw 85 of a lever locking slider 80 to be described later. The locking claw 85 engages with a vertical rear end wall 48*a* in the indented portion of the claw-engaging concave part 48.

A cap slider (hereinafter will be referred to as a slider 50) is disposed so as to freely slide on the cap frame 41. The slider 50 includes a first support pin 52 at a front surface of a lateral face 51*a* of the slider 50 and a second support pin 53 at a rear surface of the lateral face 51*a* so as to protrude from the lateral face 51*a* Similarly, a first support pin 54 and a second support pin 55 protrude from the other lateral face 51*b* of the slider 50. The first support pins 52 and 54 are components which are inserted into the first guide holes 43. The first support pin 54 protruding from the other lateral face 51*b* serves as a spring bearing part 56 so that the protruding end portion receives a first tension spring 62. In addition, the second support pins 53 and 55 are components which are inserted into the second guide holes 44.

When the first support pins 52 and 54 and the second support pins 53 and 55 slide along the guide holes 43 and 44, the slider 50 slides freely on the cap frame 41. At the same time, the slider 50 is supported so as to be movable in a moving direction of the recording head 18 and in a vertical direction where the slider 50 makes contact with the nozzle forming surface 18*a* of the recording head 18. In addition, the first support pins 52 and 54 and the second support pins 53 and 55 constitute a cam follower with respect to the cam mechanism described above.

The cap frame 41 includes a first spring bearing part 60 and a second spring bearing part 61. The first spring bearing part 60 protrudes outward from the outer surface of the sidewall 41*b*, as illustrated in FIG. 4. The first spring bearing part 60 is connected to one side of the first tension spring 62. The second spring bearing part 61 is located close to the sidewall 41*a* from the center line and protrudes into a hole portion 63 formed by cutting out a bottom surface of the cap frame 41 from a circumference portion surrounding the hole portion 63, as illustrated in FIG. 4. The second spring bearing part 61 is connected to one end of the second tension spring 64.

In addition, in the present embodiment, the second support pin 53 protruding from the lateral face 51*a* is longer than the second support pin 55 protruding from the other lateral face 51*b*. Accordingly, a space is formed between the sidewall 41*a* of the cap frame 41 and the lateral face 51*a* of the slider 50 so as to dispose a lever lock slider 80 (to be described later) in the space. In addition, the first support pin 54 protruding from the other lateral face 51*b* markedly protrudes toward the outside through the guide hole 43 so as to improve the function of the spring bearing part 56. The guide holes 43 and 44 and the supporting pins 52 to 55, described above, constitute a conversion mechanism for converting the movement of the carriage 12 into an approaching and departing movement of a cap head 90 to be described later.

By the first tension spring 62 provided between the slider 50 and the cap frame 41, the slider 50 is urged toward a printing area (rear side) of the recording head 18 and a bottom side thereof. The slider 50 is formed as a two-stage shape in which one side (a front side) is relatively high and the other side (a rear side) is relatively low (see FIG. 3). The lower stage at the other side is positioned low so as to allow a vertical movement of the cap head 90 to be described later. A ridge part 54 having an arc shape for positioning a urging component 110 (to be described later) to a fixed position is formed at a bottom portion 57 of the lower stage. Since the urging component 110 is positioned at the ridge part; 58, the urging component 110 is attached to the cap head 90 with axes thereof agreeing with each other.

In the following description, one end of the cap frame 41, one end of the slider 50, and one end of the cap head 90 are collectively referred to a front side, the other ends thereof are collectively referred to a rear side, and a direction connecting the front side and the rear side is referred to a forward and backward direction.

A plurality of positioning portions are formed in the slider 50. A first positioning portion 65 protrudes from a wall 66 at the boundary of the lower stage and the higher stage toward the rear side. The first positioning portion 65 includes a groove portion 68 indented along the center line of the slider 50 as well as a pouch-like portion 67 opened downward. The inner portion of the pouch-like portion 67 forms a guide concave part 70 and a rotation supporting member 101 of the cap head 90 to be described later is disposed in the inner portion of the pouch-like portion 67.

In addition to the above-mentioned pouch-like portion 67, a groove portion 71 indented along the center line of the slider 50 is formed in the bottom portion 57 of the lower stage. Accordingly, it is possible to attach the cap head 90 (to be described later) to the slider 50 and extend a connecting pipe 95 of the cap head 90 toward a rear surface of the slider 50.

The second positioning portion 72 corresponds to an upper end portion of the pair of lateral faces 51*a* and 51*b* surrounding the lower stage. The second positioning portion 72 collides with a flange portion 102 of the cap head 90 to be described later and receives the flange portion 102 (see FIG. 4).

A pair of rod-shaped third positioning portions 73 are disposed at the rear side of the slider 50. The third positioning portions 73 protrude from upper ends of the lateral faces 51*a* and 51*b* described above toward upper sides thereof and have a rod-shaped portion protruding from a predetermined vertical position toward rear sides. In addition, the rod-shaped third positioning portions 73 are inserted in positioning concave parts 105 of the cap head 90 to be described later.

As illustrated in FIG. 3 and FIGS. 7 to 9, a protrusion member 74 is formed at one end of the slider 50 so as to protrude upward. The protrusion member 74 corresponds to a portion with which the carriage 12 collides when moving toward the home position 22. When the carriage 12 collides with the protrusion member 74, the slider 50 moves to the one end (the front side) of the cap frame 41 thereby raising the slider 50.

The lever lock slider 80 is disposed in the space between the lateral face 51*a* of the slider and the sidewall 41*a* of the cap frame 41. The lever lock slider 80 has an L-shape, as illustrated in FIG. 3 and FIGS. 7 to 9. The lever lock slider 80 includes a slider piece 81 extending in a lateral direction and a colliding piece 82 extending in a longitudinal direction.

The slider piece 81 includes a narrow-width portion 83 having a narrow width in a vertical direction of FIG. 3 at the front side thereof and a wide-width portion 84 having a wide width in a vertical direction of FIG. 3 at the rear side thereof. In addition, the hook-like locking claw 85 is formed at the front side of the slider piece 81 so as to protrude downward. The locking claw 85 includes a locking wall 85*a* disposed vertically to the length direction of the slider piece 81 and engages with the rear end wall 48 by means of the locking wall 85*a*. In addition, in the slider piece 81, a spring bearing part 86 protrudes from a portion where the locking claw 85 is disposed toward the inside of the cap frame 41 (see FIG. 3). The spring bearing part 86 is fixed and connected to the other end of the second tension spring 64. By the second tension spring 64, a urging force is applied to the rear side and the bottom side of the lever lock slider 80.

A lever-side guide hole 87 is formed in the wide-width portion 84 of the slider piece 81. In the lever-side guide hole 87, an inclined portion 87*a* having the same inclination as the first inclined portion 44*b* and the second inclined portion 44*d* and the like of the second guide holes 44 of the cap frame 41 described above and an upper end portion 87*b* with parallel sides are provided. The second support pin 53 is inserted into the lever-side guide hole 87. As a result, as the second support pin 53 moves, the lever lock slider 80 is suppressed by the urging force of the first tension spring 62 and the second tension spring 64.

Figure 7:
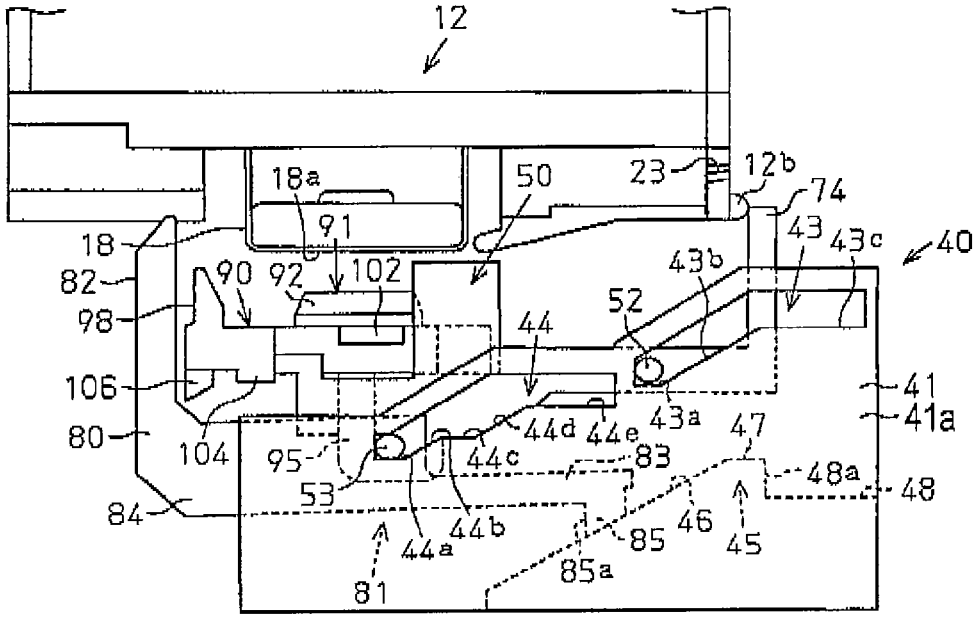
FIG. 7 is a side view of the cap unit in which a carriage is at a flushing position.
Figure 8:
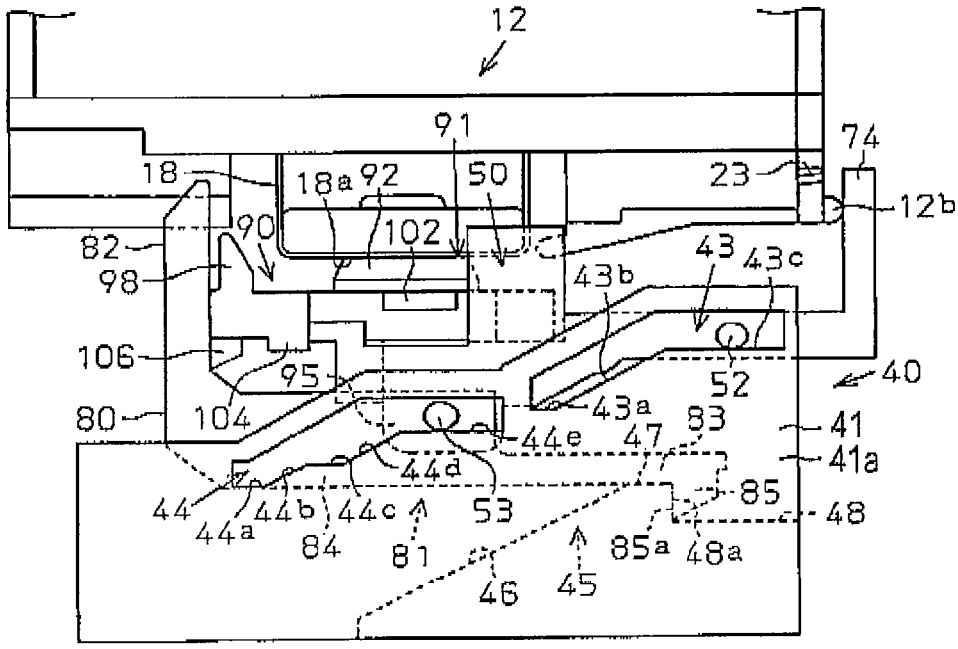
FIG. 8 is a side view of the cap unit, in which the carriage is at a suction position.
Figure 9:
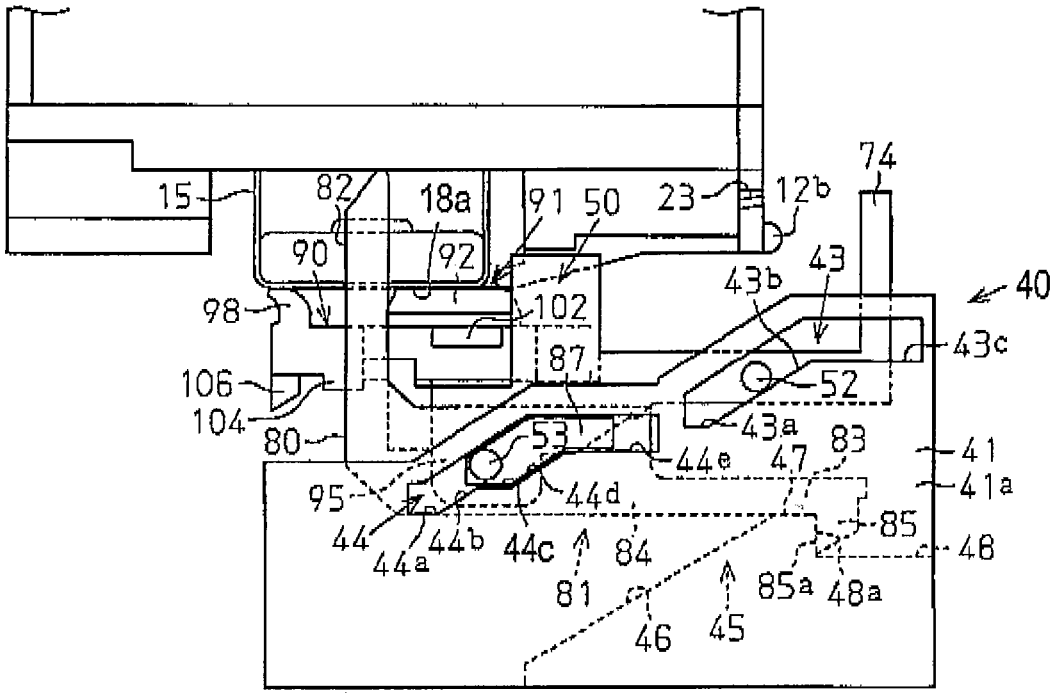
FIG. 9 is a side view of the cap unit, in which the carriage is at a wiping position.

The colliding piece 82 corresponds to a portion protruding from the rear side of the slider piece 81 toward an upper side thereof. The colliding piece 82 corresponds to a portion which collides with an engagement part 23 (see FIGS. 7 to 9) provided on the recording head 18. By this collision, the colliding piece 82 rotates the lever lock slider 80 counterclockwise as shown in FIGS. 8 and 9. As a result, the locking claw 85 of the sliding piece 81 rotates counterclockwise and is released from the engagement with the rear end wall 48*a*. Together with the release, the locking claw 85 slides along the guide slope 45 and is pulled toward the rear side of the lever lock slider 80 by the urging force of the second tension spring 64. In addition, the engagement part 23 protrudes from the lower portions of the front side of the carriage 12 toward the sidewall 41*a*, as illustrated in FIGS. 7 to 9. The engagement part 23 of the carriage 12 allows the colliding piece 82 to collide with the carriage 12 when the carriage 12 returns to the printing position. In addition, the slider 50, the cap frame 41 having the guide holes 43 and 44, the guide slope 45, the first tension spring 62, the second tension spring 64, the lever lock slider 80, and the like constitute a lifting device (lifting mechanism).

The cap head 90 is supported by the slider 50. The cap head 90 is supported by the slider 50 so as to move in a direction vertical to the slider 50 while being applied with the urging force from the urging component 110. The urging component 110 is fixed to the ridge part 58 and interposed between the cap head 90 and the slider 50 in a compressed state. Accordingly, the urging component 110 has a function of upward urging the cap head 90 with respect to the slider 50. A lock device 113 for locking the urging component 110 in a state that the urging component 110 is elastically compressed by the drive (magnetization and demagnetization) of a solenoid 114 and unlocking the urging component 110 is provided in the vicinity of the urging component 110. The lock device 113 is used to lock the urging component 110 in the elastically compressed state even when the cap head 90 is lowered so as to separate the cap part 91 from the recording head 18.

The cap part 91 of the cap head 90 corresponds to a portion that seals the nozzle forming surface 18*a* of the recording head 18 when the carriage 12 is positioned at the home position 22. In order to enhance the performance of the sealing operation, the cap part 91 includes a sealing wall 92 having a round shape and made of an elastic member such as a rubber material. In the present embodiment, the sealing wall 92 has a rectangular, shape in a plan view.

A concave part 93 is provided inside the cap part 91 surrounded by the sealing wall 92 and an absorbing member is accommodated in the concave part 93. A through-hole 94 is formed in the bottom portion of the concave part 93 and one end of the connecting pipe 95 is connected to the through-hole 94. When the other end of the connecting pipe 95 is connected to one end of the flexible tube, the inner space of the cap part 91 communicates with the suction pump 25.

In the cap head 90, an ink-receiving concave part 96 is formed at one of the rear and front sides of the sealing wall 92 and a guide member 97 is formed at the other side of the sealing wall 92. In addition, a wiping member 98 made of an elastic member such as a rubber material is disposed toward the back next to the ink-receiving concave part 96 (on the left side of FIG. 3). The wiping member 98 is used to wipe out waste ink attached to the nozzle forming surface 18*a* of the recording head 18. In addition, the sealing wall 92 and the wiping member 98 are integrally formed with a main body of the cap head 90 made of a resin by dichroic molding.

The ink-receiving concave part 96 receives the waste ink wiped by the wiping member 98. A pair of waste solution discharging ports 99 are formed in a bottom portion of the ink-receiving concave part 96. The waste solution discharging ports 99 are used to discharge the waste ink remaining in the ink-receiving concave part 96. In addition, a waste solution absorbing member (not shown) is disposed at the rear side of the ink-receiving concave part 96 with the waste solution discharging ports 99 interposed therebetween. As a result, it is possible to prevent the waste ink from dropping through the waste solution discharging ports 99, thereby preventing contamination of surroundings.

As illustrated in FIG. 4, the guide member 97 is formed to protrude by vertically erecting a rib-shaped member of a thin plate. An locking part 100 disposed in the inner portion of the groove portion 68 of the slider 50 is formed at a protruding end portion of the guide member 97. In addition, the rotation supporting member 101 protruding toward left and right directions (perpendicular to the forward and backward directions as well as the vertical direction) is formed at a bottom portion of the locking part 100. Since the rotation supporting member 101 is inserted into the guide concave part 70, the cap head 90 is prevented from moving toward the rear side thereof.

The flange portion 102 is disposed at both of the left and right sides of the sealing wall 92 of the cap head 90 so as to protrude therefrom. The bottom portion of the flange portion 102 corresponds to a portion that collides with the second positioning portion 72 of the slider 50. By this collision, the flange portion 102 positions the slider 50 to a lower side of the cap head 90.

A pair of positioning concave parts 105 are disposed at the rear side of the cap head 90. The positioning concave parts 105 correspond to the portions into which the rod-shaped third positioning portions 73 are inserted. When the third positioning portions 73 are inserted into the positioning concave parts 105, bottom walls 105*a* of the positioning concave parts 105 make contact with the third positioning portions 73 while suppressing the urging force of the urging component 110, thereby restricting the cap head 90 from moving upward. By this restriction, an upper limit position of a movable range in which the cap head 90 can move in a vertical direction with respect to the slider 50 is defined.

A rear side rib 106 is formed so as to protrude from the rear side of the cap head 90. The rear side rib 106 correspond to a portion that collides with the upper end of the rear end wall 41*d* when the second support pin 53 is positioned at the intermediate portion 44*c*. By this collision, the lower limit of lowering the cap head 90 when the second support pin 53 is positioned at the intermediate portion 44*c* is restricted.

Figure 5A:
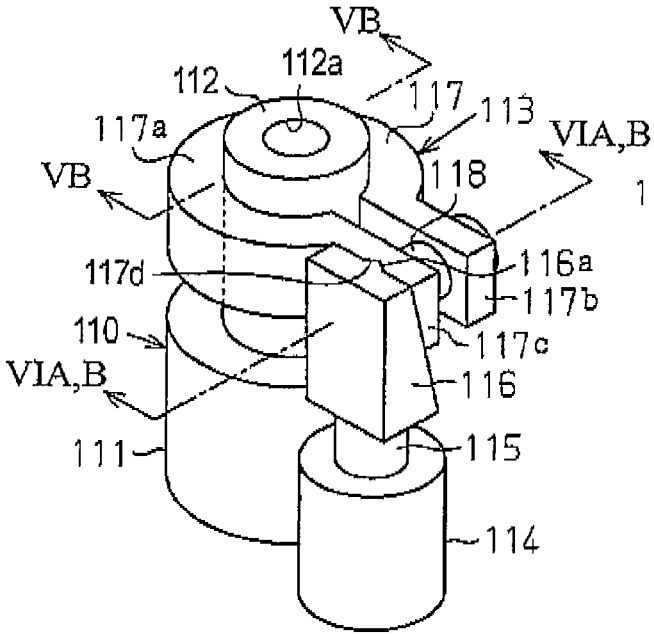
FIG. 5A is a perspective view of a urging component and a lock device according to an embodiment of the invention.
Figure 5B:
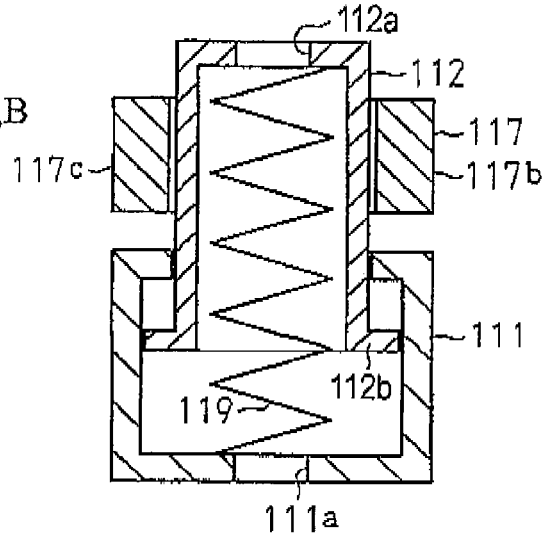
FIG. 5B is a schematic side-sectional view of the urging component.

Hereinafter, the arrangement of the urging component 110 and the lock device 113 will be described in detail with reference to FIGS. 5 and 6. FIG. 5A is a perspective view of the urging component and the lock device according to the present embodiment and FIG. 5B is a schematic side-sectional view taken along the VB-VB line shown in FIG. 5A. FIG. 6 is a schematic sectional view of the lock device taken along the VIA-VIA line shown in FIG. 5A in order to illustrate the advantages of the lock device.

As illustrated in FIGS. 5A and 5B, the urging component 110 includes a main body 111 having a cylindrical shape, a cylindrical movable rod 112 inserted into the main body 111 so as to partially protrude from the front end hole of the main body 111, and a coil spring 119 accommodated in the main body 111 and urged toward the protruding part of the movable rod 112. In the vicinity of the urging component 110, a lock device 113 serving as a locking unit for locking the movable rod 112 of the urging component 110 and fixing the amount of protrusion of the movable rod 112 is provided. The lock device 113 includes a solenoid 114 (a driving unit), a slide plate 116 fixedly attached to the front end portion of a rod 115 of the solenoid 114, and a choke member 117 loosely fitted to the outer surface of the movable rod 112. The choke member 117 includes an annular portion 117*a* having a circular ring shape and formed by bending a strip-like plate having a predetermined length at a center portion thereof and a pair of plate portions 117*b* and 117*c* extending from the annular portion 117*a* in a direction parallel to each other and with a predetermined gap between the both ends thereof. In the choke member 117, when the gap between the pair of plate portions 117*b* and 117*c* is narrowed by an external force, a tightening force is applied so as to narrow the inner diameter of the annular portion 117*a*. A shaft member 118 is fixedly attached to one plate portion 117*b* in an inserted state and a front end portion of the shaft member 118 in the insertion direction is partially inserted into a circular aperture (not shown) having a predetermined depth and indented at an opposing face of the other plate portion 117*c*. In addition, when the gap between the pair of plate portions 117*b* and 117*c* is narrowed by an external forcer the front end portion of the shaft member 118 can be inserted into the circular aperture in the depth direction of the circular aperture. An engagement groove 117*d* is formed at an outer face of the plate portion 117*c* into which the shaft member 118 is partially inserted. The engagement groove 117*d* engages with an engagement convex portion 116*a* formed at a face opposing the plate portion 117*c* of the slide plate 116.

Figure 6A:
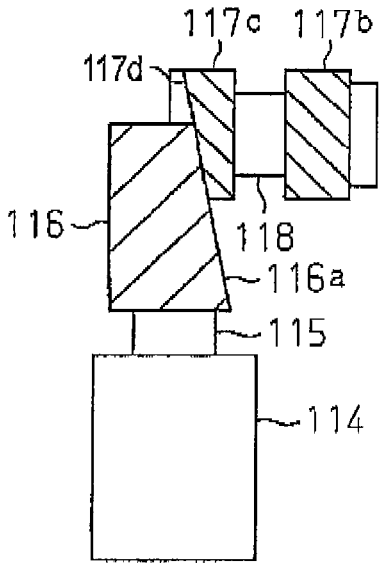
FIGS. 6A and 6B are schematic side views of the lock device corresponding to an unlock state and a lock state, respectively.
Figure 6B:
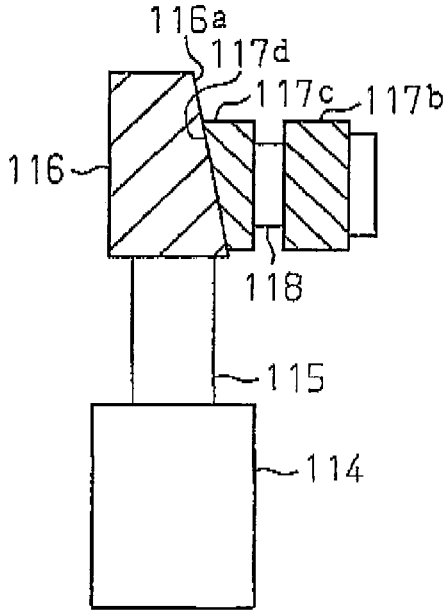

As illustrated in FIGS. 6A and 6B, the engagement groove 117*d* is formed at an inclined groove in, which the depth of the groove 117*d* increases downward with respect to the axial direction of the solenoid 114. On the other hand, the engagement convex portion 116*a* is formed as an inclined ridge having the same inclination angle as the engagement groove 117*d* in which the amount of protrusion increases downward with respect to the axial direction of the solenoid 114. The choke member 117 is integrated into the slider 50 in a state that the choke member 117 is attached to the slider 50 and is fixed at a constant vertical position from the bottom portion of the slider 50.

Therefore, as illustrated in FIG. 6A, when the solenoid 114 is demagnetized and the slide plate 116 is positioned at a low position, the amount of pressure applied on the engagement convex portion 116*a* and the engagement groove 117*d* by the plate portion 117*c* decreases and the choke member 117 allows the movement of the movable rod 112 without tightening the movable rod 112. On the other hand, as illustrated in FIG. 6B, when the solenoid 114 is magnetized and the slide plate 116 is positioned at a high position, the amount of pressure applied on the engagement convex portion 116*a* and the engagement groove 117*d* by the plate portion 117*c* increases and the choke member 117 tightens the movable rod 112 by the annular portion 117*a*. By this tightening, the movable rod 112 is fixed.

As illustrated in FIG. 5B, the urging component 110 includes an insertion hole 112*a* formed on a front end wall of the movable rod 112 as well as an insertion hole 111*a* formed on a bottom wall of the main body 111. The connecting pipe 95 of the cap head 90 and a tube connected to the connecting pipe 95 are pulled toward the inner portion of the urging component 110 from the insertion hole 112*a* of the movable rod 112. The pulled tube is drawn out toward the outside of the urging component 110 from the insertion hole 111*a* of the main body 111 and is connected to the suction side of the suction pump 25. In addition, the urging component 110 has an inherent initial urging force in addition to an inherent spring constant. The urging force of the urging component 110 is controlled such that the sealing wall 92 can efficiently seal the nozzle forming surface 18*a* of the recording head 18. Since the wiping member 98 is separated from the axial line of the sealing wall 92 and the urging component 110 by a predetermined distance, the urging force applied to the wiping member 98 should be weaker than that applied to the sealing wall 92, from the principle of leverage. In addition, as illustrated in FIG. 58, when a locking portion 112*b* formed at a lower end of the movable rod 112 engages with an upper wall of the main body 111, the movable rod 112 is retained with respect to the main body 111.

Next, the operation of the recording apparatus 10 and the cap unit 40 having the above-mentioned arrangement will be described.

For example, the cleaning operation of the recording head 18 is executed when the recording apparatus 10 resumes a recording operation after a long idling period or when the user recognizes a recording failure and presses a cleaning switch 125 (see FIG. 10), for example. During the cleaning operation, the recording head 18 moves from the printing area to the home position 22, together with the carriage 12.

At this time, the protrusion member 74 engages with the engagement part 23 and the support pins 52 to 55 are guided through the first guide hole 43 and the second guide hole 44, respectively. Accordingly, the slider 50 is raised with respect to the cap frame 41 while sliding forward on the cap frame 41. In this case, since the support pins 52 to 55 move toward the upper end portions 43*c* and 44*e* from the lower end portions 43*a* and 44*a*, the slider 50 is raised by the cap frame 41.

In this manner, as the slider 50 is raised, the sealing wall 92 makes contact with the nozzle forming surface 18*a* and seals the nozzle forming surface 18*a*. In addition, the recording head 18 moves from the home position 22 to the suction position as illustrated in FIG. 8. In this case, by the pulling force of the second tension spring 64, the lever lock slider 80 rotates about the second support pin 53 in the clockwise direction shown in FIG. 8. Accordingly, the locking claw 85 falls on the claw-engaging concave part 48.

By this falling, the locking wall 85*a* of the locking claw 85 engages with the rear end wall 48*a* of the claw-engaging concave part 48. In this state, the suction pump 25 performs the sucking operation. Accordingly, a negative pressure is applied to the space surrounded by the nozzle forming surface 18*a* and the cap part 91 and ink is sucked and discharged from the recording head 18. In this manner, the ink clogged in the nozzle orifices is removed.

Thereafter, when the recording head 18 moves toward the printing area from the suction position as illustrated in FIG. 8 to a start point of the wiping position as illustrated in FIG. 9, the support pins 52 to 55 are guided through the first guide hole 43 and the second guide hole 44, respectively. Accordingly, the slider 50 is lowered with respect to the cap frame 41 while sliding backward on the cap frame 41. In this case, the second support pins 53 and 55 move from the upper end portion 44*e* to the intermediate portion 44*c*. In addition, although the locking wall 85*a* of the locking claw 85 collides with the rear end wall 48*a* of the claw-engaging concave part 48, since the lever lock slider 80 is applied with an urging force in the clockwise direction shown in FIG. 8 by the second tension spring 64, the locking wall 85*a* maintains its collision state with the rear end wall 48*a*.

As a results the second support pins 53 and 55 are positioned at the intermediate portion 44*c* and the slider 50 is held in an intermediate position. Since the slider 50 is held in the intermediate position, the nozzle forming, surface 18*a* sealed by the sealing wall 92 is released from its sealing state. At the same time, the wiping member 98 is positioned at a vertical position in which the wiping member 98 comes in sliding contact with the nozzle forming surface 18*a* of the recording head 18 and waits at this position.

When the recording head 18 moves further toward the printing area from the start point of the wiping position as illustrated in FIG. 9, the wiping member 98 comes in sliding contact with the nozzle forming surface 18*a* and wipes out ink attached to the nozzle forming surface 18*a*, i.e., executes the cleaning (wiping) operation. When the wiping member 98 performs the cleaning operation on the nozzle forming surface 18*a*, the cap head 90 downward rotates about the rotation supporting member 101 and the rear end rib 106 collides with the rear end wall 41*d*. Accordingly, the cap head 90 is restricted from rotating downward and the wiping member 98 is elastically deformed and comes in sliding contact with the nozzle forming surface 18*a*. In this case, even when ink droplets are hardened at the nozzle forming surface 18*a*, the wiping member 98 is elastically deformed without escaping downward, thereby securing the operation of cleaning the nozzle forming surface 18*a*.

Thereafter, as the recording head 18 further moves toward the printing area, the engagement part 23 collides with the collision piece 82 and the lever lock slider 80 rotates counterclockwise as shown in FIG. 9. Accordingly, as the locking claw 85 is released from its engagement state with the claw-engaging concave part 48, the slider 50 moves toward the rear side by the first tension spring 62 and the lever lock slider 80 moves downward by the second tension spring 64. In a state that the movement of the recording head 18 is stopped, the support pins 52 to 55 are positioned at the lower end portions 43*a* and 44*a*.

In the recording apparatus 10 according to the present embodiment, whenever a predetermined number of lines or pages of the recording sheet 17 is printed, the recording head, 18 moves from the printing area to the flushing position as illustrated in FIG. 7. Since the flushing position is positioned right ahead of the home position 22, the cap head 90 is not raised through the guide holes 43 and 44 and the support pins 52 to 55 are positioned at low positions, i.e. at the lower end portions 43*a* and 44*a*. Therefore, the upper end of the sealing wall 92 is separated from the nozzle forming surface 18*a* and the wiping member 98 is positioned at a position in which the wiping member 98 does not come in contact with the nozzle forming surface 18*a*.

In this state, when a drive signal not serving as print data is applied to the recording head 18, an idle discharging (flushing) operation in which ink droplets are discharged from the recording head 18 toward the cap part 91 is performed. Thereafter, the wiping member 98 dose not perform the wiping operation on the nozzle forming surface 18*a*, the recording head 18 moves again from the flushing position as illustrated in FIG. 7 toward the printing area, and the recording head 18 resumes the recording operation. In addition, in the present embodiment, the capping position in which the cap part 91 seals the nozzle forming surface 18*a* in order to prevent the inks in the nozzle orifices from drying is identical to the suction position. Alternatively, the capping position may be set to be different from the suction position.

Figure 10:
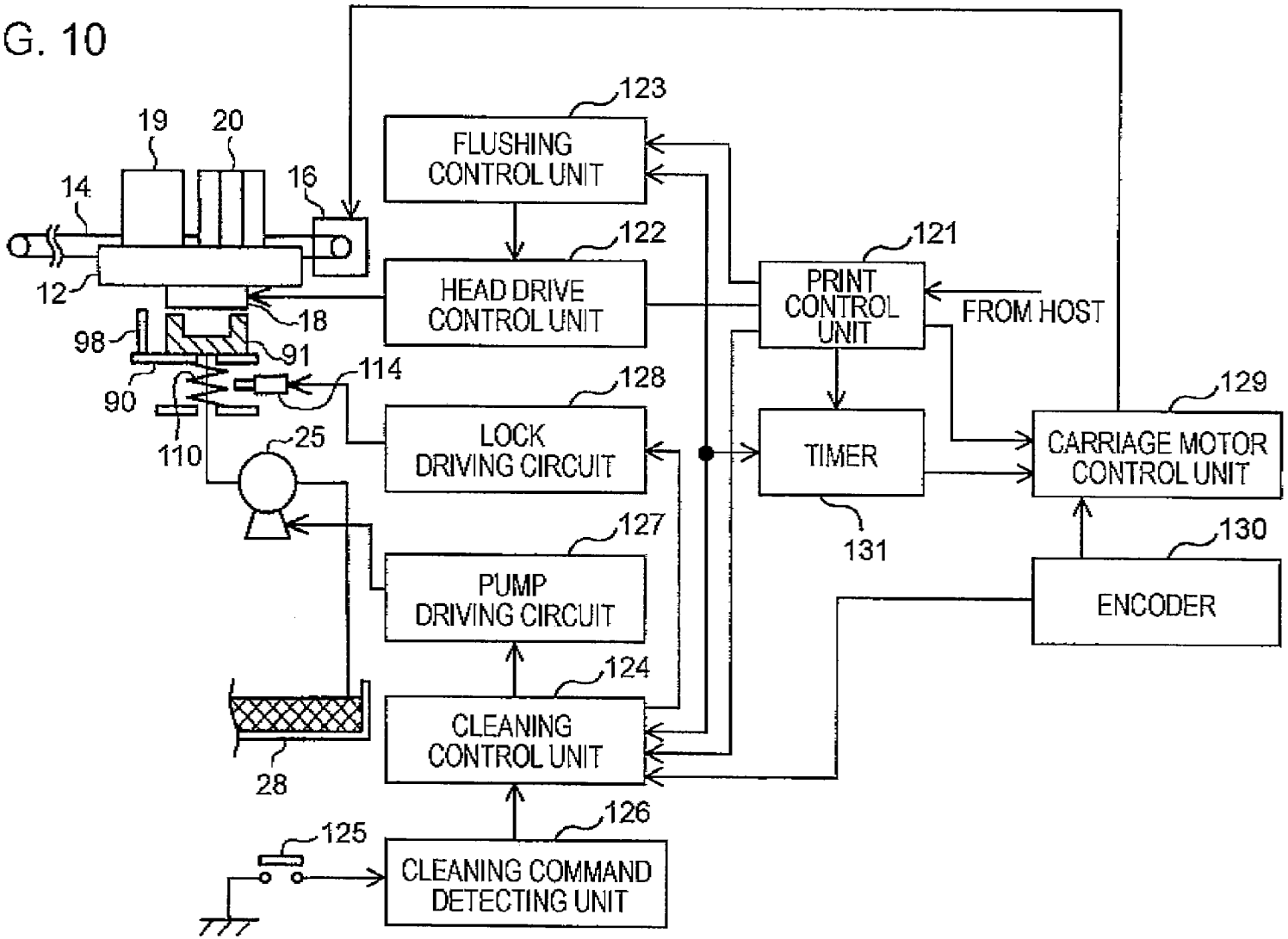
FIG. 10 is a block diagram of an electrical arrangement of the recording apparatus.

FIG. 10 illustrates the electrical arrangement of the recording apparatus. In FIG. 10, previously described components including the carriage 12, the carriage motor 16, the ink cartridges 19 and 20, the suction pump 25, the waste liquid tank 28, the cap part 91, the wiping member 98, the urging component 110, the solenoid 114, and the cleaning switch 125 will be denoted by the seine reference numeral as those used in the previous figures.

As illustrated in FIG. 10, a print control unit 121 produces bit map data based on the print data output from a host computer (not shown), generates a drive signal based on the bit map data and transmits the drive signal to a head drive control unit 122, and discharges ink droplets from the recording head 18 mounted on the carriage 12. The head drive control unit 122 receives a flushing command signal from a flushing control unit 123 in addition to the drive signal generated base on the print data and outputs the drive signal for the flushing operation to the recording head 18.

The cleaning control unit 124 performs the cleaning operation in response to a command signal from a cleaning command detecting unit 126 when the cleaning switch 125 located on an operation panel, for example, is turned on. Moreover, the cleaning control unit 124 performs the cleaning operation when the cleaning control unit 124 receives a cleaning command signal from the host computer via the print control unit 121.

When the cleaning control unit 124 receives the cleaning command signal, the cleaning control unit 124 controls a pump driving circuit 127 so as to drive the suction pump 25. By the driving operation of the suction pump 25, the negative pressure is applied to the inner space of the cap part 91 (a space enclosed by the cap part 91 and the nozzle forming surface 18*a*) and the ink is sucked and discharged from the nozzle orifices of the recording head 18. In addition, when the suction pump 25 is driven again in a state that the nozzle forming surface 18*a* sealed by the cap part 91 is released from its sealing state, the waste ink discharged into the cap part 91 is collected into the waste liquid tank 28.

An encoder 130 has a function of detecting the moving position of the carriage 12, for example, by an optical method. To this end, a number of optical slits are, arranged in the moving direction of the carriage 12. According to the scan movement of the carriage 12, the number of interruptions of light passing through the slits is counted, thereby detecting the moving position of the carriage 12.

In addition, signals from the encoder 130 are supplied to the cleaning control unit 124. When the cleaning control unit 124 receives the cleaning command signal and the carriage 12 reaches at a predetermined position corresponding to the signals from the encoder 130, the cleaning control unit 124 generates a magnetization signal and transmits the magnetization signal to the lock driving circuit 128, thereby magnetizing the solenoid 114 and protruding the rod 115. In addition, the cleaning control unit 124 receives a printing start command from the printing control unit 121 in a state that the carriage 12 is positioned at the home position 22, the cleaning control unit 124 generates a demagnetization signal and transmits the demagnetization signal to the lock driving circuit 128 before the carriage 12 starts to depart from the home position (the capping position). On the basis of the demagnetization signal, the lock driving circuit 128 demagnetizes the solenoid 114 and retracts the rod 115.

The signals from the encoder 130 are supplied to the carriage motor control unit 129. The carriage motor control unit 129 detects the position of the carriage 12 on the basis of the signals from the encoder 130 and controls the carriage motor 16 in accordance with the position of the carriage 12, thereby controlling the speed of the carriage 12 or changing the traveling direction of the carriage 12.

In addition, control signals are output from a timer 131 to the flushing control unit 123, the cleaning control unit 124, and the carriage motor control unit 129 after respective time periods set by the timer 131 have elapsed. When the printing is continuously performed for a predetermined time (e.g., 10 seconds) during the printing operation, the timer 131 outputs a control signal to the flushing control unit 123 and the carriage motor control unit 129. On the basis of the control signal, the carriage motor control unit 129 moves the carriage 12 to the flushing position and the flushing control unit 123 outputs a drive signal to the head drive control unit 122 so as to perform the flushing operation on the recording head 18.

In addition, the timer 131 counts the time elapsed after the previous sucking operation and outputs the control signal to the cleaning control unit 124 and the carriage motor control unit 129 when the elapsed time is greater than a preset time period (for example, a few hours or a few days) or when the power is initially activated after the elapse time. On the basis of the control signal, the carriage motor control unit 129 moves the carriage 12 to the suction position (the same as the capping position in the present embodiment), thereby sealing the recording head 18 to the cap part 91. In addition, right after the sealing of the recording head 18 is completed, the cleaning control unit 124 outputs a drive signal to the pump driving circuit 127 and drives the suction pump 25, thereby performing the sucking operation of ink from the recording head 18. In the present embodiment, the cap unit 40 and the suction pump 25 constitute the cleaning device.

Figure 11:
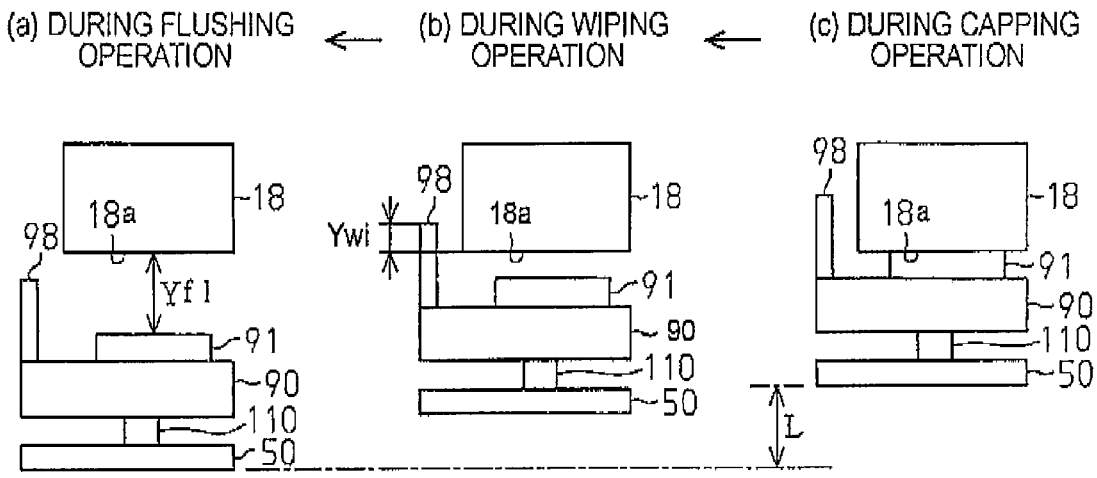
FIGS. 11A to 11C are schematic views for explaining the operation, in which the cap head is lowered.
Figure 12:
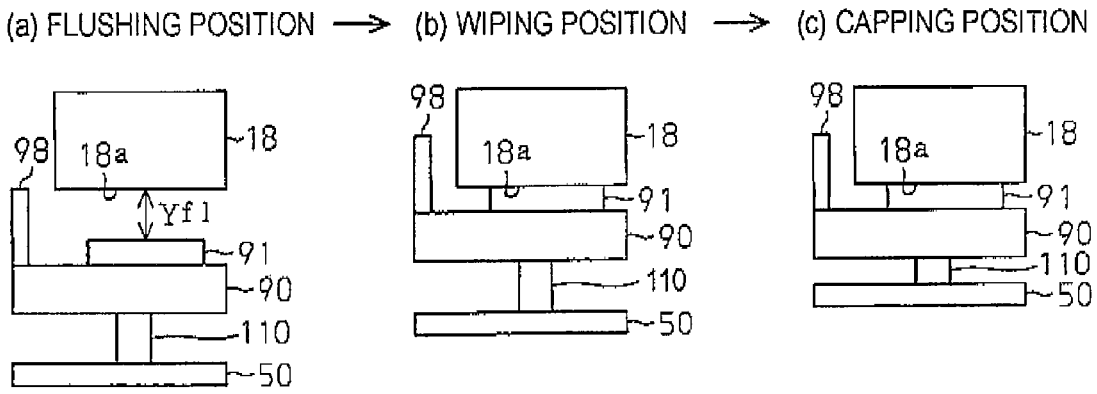
FIGS. 12A to 12C are schematic views for explaining the operation, in which the cap head is raised.
Figure 13:
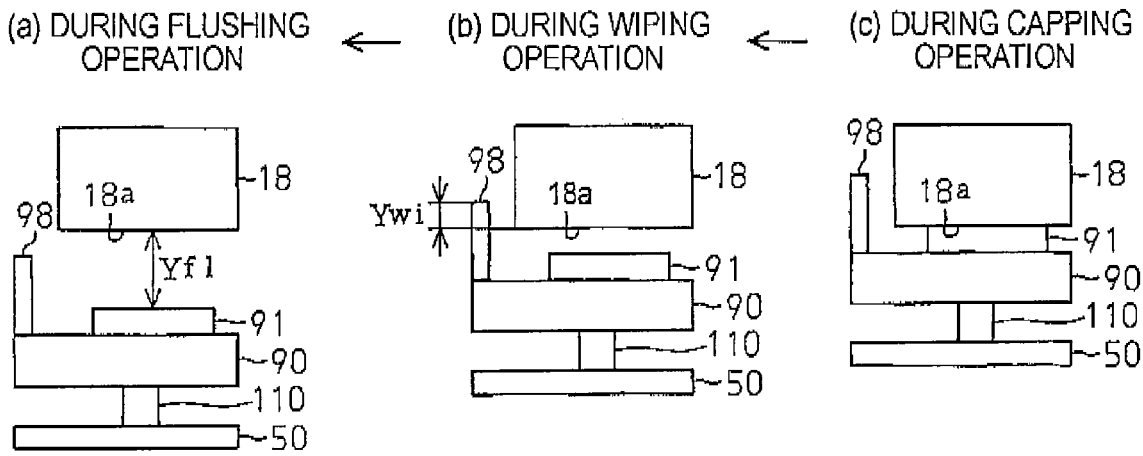
FIGS. 13A to 13C are schematic views for explaining the operation of the cap unit, in which the platen gap is large.

Next, the operation of the cleaning device having the above-mentioned arrangement will be described, FIGS. 11A to 11C are diagrams for explaining the operation in which the urging component 110 is fixed to the lock device 113. FIGS. 11A to 11C illustrate the positional relationships between the recording head 18 and the cap head 90 during the flushing operation, the wiping operation, and the capping operation, respectively. FIGS. 12A to 12C are views fox explaining the operation in which the urging component 110 locked at the lock device 113 is released from its lock state. Similar to FIGS. 11A to 11C, FIGS. 13A to 13C illustrate the positional relationships between the recording head 18 and the cap head 90 during the flushing operation, the wiping operation, and the capping operation, respectively. However, FIGS. 13A to 13C correspond to the case where the platen gap is large. In FIGS. 11 to 13, the lock device 113 is omitted and components are drawn schematically in order to show the length of the urging component 110 at the time of the lock state and the lock-release state.

As illustrated in FIG. 11A, during the sucking operation and the capping operation, when the carriage 12 is positioned at the printing area, the carriage 12 moves from the printing area toward the capping position across the flushing position. In the course of the movement, as the support pins 52 to 55 are guided through the guide holes 43 and 44, the slider 50 is raised while moving forward together with the carriage 12. As a results the slider 50 reaches an uppermost position and the cap head 90 is raised together with the slider 50, as illustrated in FIG. 11C. Accordingly, the cap part 91 makes contact with the recording head 18 in a state that the cap part 91 is upward urged by the urging component 110. Therefore, the recording head 18 is securely sealed by the cap part 91. In the capping operation, the urging component 110 is compressed as illustrated in FIG. 11C but is not locked. This capping process corresponds to a sealing step in the cleaning method of the present embodiment.

The cleaning operation (the operation of sucking and discharging ink) is performed in a state that the urging component 110 is released from its lock state. This is to prevent an ink suction force from decreasing when a minute gap is generated between the nozzle forming surface 18*a* and the cap part 91 and air flows in the cap part 91 so as to destroy the negative pressure in the cap part 91 due to weak vibration resulting from the ink sucking operation performed by driving the suction pump 25. Therefore, even when a weak vibration is generated during the ink sucking operation, since the urging component 110 is elastically expanded so as to absorb the displacement due to the weak vibration and the nozzle forming surface 18*a* and the cap part 91 are maintained at a good sealing state in which the cap part 91 securely makes contact with the nozzle forming surface 18*a*, the operation of sucking and discharging ink is efficiently performed. This process of sucking and discharging ink corresponds to a sucking step in the cleaning method of the present embodiment.

When the cap head 90 is lowered from the capping state, the cap head 90 is locked by the solenoid 114 right before the lowering. Detection of a lowering time point that triggers the locking operation is controlled by respective control units and the time point may be identified by detecting a predetermined command such as a print command or a cleaning command. Examples of the time point are as follows:

(1) when the printing operation is initiated in a state that the carriage 12 is positioned at the capping position;
(2) when the carriage 12 starts to move for a purpose other than the printing purpose in a state that the carriage 12 is positioned at the capping position (initialization process, for example);
(3) when the wiping operation is executed after the sucking operation; and
(4) when the capping operation is executed in a state that the carriage 12 is positioned at the capping position.

Since the operations (1) to (4) are selectively adapted for the recording apparatus 10 in accordance with types thereof, the operation (4), for example, may be omitted.

When the operations are executed, any one of the print control unit 121, the cleaning control unit 124, and the flushing control unit 123 (the case where the operation (4) is provided) can recognize the initiation of moving the carriage 12 toward the capping position in advance. Therefore, the cleaning control unit 124 recognizes the initiation of the movement of the carriage 12 toward the capping position on the basis of command signals from the print control unit 121 the flushing control unit 123, and the like or a signal from the timer 131 and outputs a magnetization signal to the lock driving circuit 12S before the initiation of the movement. On the basis of the magnetization signal, the lock driving circuit 128 magnetizes the solenoid 114 so as to lock the urging component 110 in the elastically compressed state. The carriage motor control unit 129 drives the carriage motor 16 so as to initiate the movement of the carriage 12 toward the capping position before and after the time of locking the urging component 1104 In the present embodiment, when the slider 50 is positioned at the uppermost position, specifically at a time point before initiating the driving of the carriage motor 16, the solenoid 114 is magnetized so as to lock the urging component 110.

The time point of locking the urging component 110 may be any time point on condition that the cap part 91 (i.e., the sealing wall 92) makes contact with the nozzle forming surface 18*a* and is positioned at a position lower than the upper limit position of a movable range in a longitudinal direction with respect to the slider 50 and the length of the urging component 110 is shortened in an elastically compressed state from the maximum length thereof. Therefore, an intermediate time point during the lowering operation before the cap part 91 is separated from the nozzle forming surface 18*a* may be selected as the locking time point. For example, the solenoid 114 may be magnetized at a time point in which the slider 50 is slightly lowered after the initiation of driving the carriage motor 16. In this case, it is preferable to align time points from initiating the driving of the carriage motor 16 (i.e., initiation of lowering a lifting part (the slider 50) of a lifting unit) to locking the urging component 110 at all times. For example, it is desirable to magnetize the solenoid 114 when it is detected that the carriage 12 has moved from the capping position by a predetermined amount and reached a predetermined position on the basis of the signal from the encoder 130. This process of locking the urging component 110 corresponds to a locking step in the cleaning method of the present embodiment.

After the operation of sucking and discharging ink is completed, when the wiping operation is executed as illustrated in FIG. 11B, the carriage 12 starts to move toward the capping position and passes the wiping position in a state that the urging component 110 is locked at the elastically compressed state. When the platen gap is small, the compression amount of the urging component 110 is great and the length of the urging component 110 is maintained to be considerably short. To the contrary, when the platen gap is large, the compression amount of the urging component 110 is small and the length of the urging component 110 is maintained to be slightly short. In this manner, even though the vertical position of the recording head 18 is changed as the platen gap is adjusted in accordance with the thickness of sheet, when the cap part 91 is lowered from the state that the cap part 91 makes contact with the nozzle forming surface 18*a* and the cap part 91 is separated from the nozzle forming surface 18*a*, the urging component 110 in the locked state does not recover its original length. Accordingly, the urging component 110 is locked at a length shorter than the original length. As a result, when the carriage 12 moves from the capping position to the wiping position and in conjunction with the movement, the slider 50 is lowered by a predetermined amount and the cap part 91 is positioned at the wiping position, the distance between the cap part 91 and the nozzle forming surface 18*a* is maintained at an approximately constant amount corresponding to the lowering amount of the slider 50. More specifically, the constant amount is the difference between the lowering amount of the slider 50 and the amount of elastic recovery of the sealing wall 92. In the present embodiment, the distance in the wiping operation is set to a constant value such that the amount of interference Ywi between the wiping member 98 and the nozzle forming surface 18*a* can be set to an optimal value. The amount of interference Ywi can be set to a constant value by adjusting the lowering amount of the slider 50 which slides down in conjunction with the carriage 12 that moves from the capping position to the wiping position. More specifically, the amount of interference Ywi can be set to a constant value by designing and fabricating the lengths the first guide hole 43 and the second guide hole 44 formed in the cap frame 41 to obtain the amount of interference Ywi.

In this manner, during the wiping operation performed in the process of passing the carriage 12 through the wiping position, the amount of interference Ywi between the wiping member 98 and the nozzle forming surface 18*a* is always suitably set to an approximately constant value regardless of the vertical position of the recording head 18. Accordingly, the wiping operation is always efficiently performed. In the present embodiment in which the urging component 110 is locked to prevent the recovery from the elastic deformation, the lowering amount of the slider 50 set to obtain a suitable amount of interference Ywi is decreased by the amount of elastic recovery that should be recovered when the urging device of known cleaning apparatus is not locked. That is, the lengths of the first guide hole 43 and the second guide hole 44 can be shortened. In addition, after the wiping operation is completed, when the carriage 12 passes the flushing position, moves into the printing area, and reaches a predetermined area, the printing operation is initiated, for example. In this case, the process in which the carriage 12 moves from the capping position to the start point of the wiping position and the cap head 90 is lowered to the wiping position corresponds to a lowering step during the wiping operation in the cleaning method of the present embodiment. In addition, the process of wiping corresponds to a wiping step in the cleaning method of the present embodiment.

In aforementioned description, although the description is for the case where the sucking operation of ink is performed in the capping state, even in the capping operation in which the cap part 91 makes contact with the nozzle forming surface 18*a* in order to prevent the ink in the nozzle from drying, the urging component 110 is locked in the elastically compressed state before initiating the operation of lowering the cap part 91. For example, when the power is supplied to the recording apparatus 10, the recording head 18 is in the capping state (FIG. 11C). When the carriage 12 makes its first movement for the purpose of an initialization process, the urging component 110 is locked before the carriage 12 starts to move. At the time of the power supply, when a preset time period has already been elapsed after the pervious ink sucking operation, as described above, the urging component 110 is locked after the ink sucking operation is completed and before the initiation of lowering the cap part 91 for the next wiping operation. For this reason, when the carriage 12 is positioned at a position other than the capping position (for example, the flushing position within the printing area, the wiping area, and the like) after the power has been supplied, the urging component 110 is always locked in the elastically compressed state.

While the carriage 12 is performing the printing operation in the printing area, the urging component 110 is locked in the elastically compressed state. At a predetermined time for the flushing operation is reached during the printing operation, a signal is transmitted from the timer 131 to the flushing control unit 123 and the carriage motor control unit 129. On the basis of the signal, the carriage motor control unit 129 controls the carriage motor 16 so as to move the carriage 12 toward the flushing position. Concurrently, the flushing control unit 123 generates a drive signal, transmits the drive signal to the head drive control circuit 122, and performs the flushing operation on the recording head is at a time point in which the carriage 12 reaches the flushing position.

As illustrated in FIG. 11A, the gap Yfl between the nozzle forming surface 18*a* and the top surface of the ink absorbing member in the concave part 93 of the cap part 91 during the flushing operation is always maintained at an approximately constant value regardless of the vertical position of the recording head 18 (i.e. the platen gap). In the present embodiment, the approximately constant gap Yfl is set to a distance within a predetermined range in which the liquid droplets discharged in the flushing operation does not become mist, in particular, to a suitable distance that is the shortest (for example, Yfl is a value between 2 mm and 4 mm). The flushing process corresponds to a flushing step in the cleaning method of the present embodiment. In general, in the lowering operation, since the carriage 12 passes the flushing position, the flushing operation is not performed right after the lowering operation but is performed when the carriage 12 moves to the flushing position at the flushing period in the course of performing the printing operation after the lowering operation. In addition, the process in which the carriage 12 moves from the capping position to the wiping position and the cap head 90 is positioned at the intermediate position (the wiping position) corresponds to a lowering step during the wiping operation in the cleaning method of the present embodiment.

In the known cleaning device, in order to secure a flushing gap Yfl at the suitable range (for example, between 2 mm and 4 mm), it is necessary to set the vertical position of the slider 50 at the flushing position, such that a minimum distance (for example, Yfl is 2 mm) is secured when the recording head is positioned at the lowermost position. In this case, since the flushing gap Yfl when the recording head is positioned at the uppermost position becomes a value (for example, 5 mm) that is greater than the gap Yfl (for example, 2 mm) at the lowermost position by an amount corresponding to a lifting stroke (for example, 3 mm) of the recording head adjusted by the platen gap adjusting mechanism 30, the liquid droplets discharged in the flushing operation have to travel a longer distance (for example, 5 mm) to reach the cap part 91. Accordingly, the discharged liquid droplets are likely to become mist. To the contrary, in the present embodiment, since it is always possible to set the gap Yfl to an approximately constant small value (for example, 2 mm) regardless of the vertical position of the recording head 18, the discharged liquid droplets are unlikely to become mist even when the platen gap is adjusted to an arbitrary value.

In the known cleaning device, when the flushing operation is performed in a state that the recording head is positioned at the lowermost position in which the recording head is lowered nearest to the cap part (minimum platen gap position), the vertical position of the slider at the flushing position is set to secure the required distance (for example, 2 mm). In this case, comparing the lowering amount of the cap part to the flushing position, since in the known cleaning device, the spring (urging unit) that urges the cap part when the cap part is lowered is expanded due to the elastic recovery force, the amount of interference Ywi in the present embodiment can be obtained by further lowering the cap part by an amount corresponding to the expansion amount (the amount of elastic recovery). For this reason, according to the cap unit 40 of the present embodiment, it is possible to reduce the lowering amount of the slider 50 from the capping position to the wiping position in order to attain the same amount of interference Ywi, compared to the known cleaning device.

In addition, the lifting stroke amount of the slider 50 as illustrated in FIG. 11 can be set by the method of setting the gap Yfl at the time of lowering from the wiping position to the flushing position. In the known cleaning device, when the flushing operation is performed in a state that the recording head is lowered to the lowermost position (even when the spring is expanded to the maximum length), it is necessary to set the vertical position of the slider at the flushing position in order to secure a minimum gap in which the cap part does not make contact with the nozzle forming surface. To the contrary, according to the present embodiment, when the flushing operation is performed in a state that the recording head 18 is lowered to the lowermost position, since it is only required to ensure a minimum gap for the cap part 91 not to make contact with the nozzle forming surface 18*a*, it is possible to set the vertical position of the slider 50 at the flushing position to a relatively high position by an amount corresponding to the compression amount (a maximum compression amount) of the urging component 110 when the recording head 18 is lowered to the lowermost position. In other words, during the capping state in which the recording head 18 is lowered to the lowermost position (the minimum platen gap position) and the cap part 91 makes contact with the nozzle forming surface 18*a*, it is possible to shorten the lifting stroke of the slider 50 shorter compared to the known cleaning device by an amount corresponding to the compression amount (the maximum compression amount) based on the length (i.e., maximum movable length) of the urging component 110 when the elastically compressed urging component 110 recovers its original shape.

As seen from the foregoing description, in the present embodiment in which a lifting unit slides the slider in conjunction with the movement of the carriage 12, since it is possible to shorten the lifting stroke of the slider 50, the moving stroke amount of the slider 50 in the moving direction of the carriage 12 is set to a small value compared to the known cleaning device. Since the moving stroke amount of the slider 50 is set to a small value, the size of the capping unit 40 becomes shorter in a vertical direction as well as in the moving direction (forward and backward direction) of the carriage 12, compared to the known cleaning device. Therefore, it is possible to downsize the cap unit 40 according to the present embodiment.

As illustrated in FIG. 12, the unlocking of the urging component 110 is performed in the capping operation. In the capping operation, as the carriage 12 sequentially moves from the printing area to the capping position, the carriage 12 passes the flushing position (FIG. 12A), the wiping position (FIG. 12B), and the capping position (FIG. 12C). When it is detected from the signal from the encoder 130 that the carriage 12 has reached the flushing position illustrated in FIG. 12A, the solenoid 114 is demagnetized and the urging component 110 is unlocked. After passing the flushing position, the carriage 12 moves in engagement with the slider 50. In FIG. 128, since the urging component 110 is in an unlocked state when the carriage 12 is at the wiping position, the gap that is set in consideration of the compressed state (lock state) of the urging component 110 is almost cleared and the cap part 91 quickly makes contact with the nozzle forming surface 18*a* before reaching the capping position. In this manner, even when the contact is made quickly at the wiping position, since the recording head 18 has already passed the wiping member 98 and the slider 50 and the carriage 12 move as a single body in a state that the cap part 91 makes contact with the nozzle forming surface 18*a*, the cap part 91 does not slide on the slider 91, thereby causing no problems. In addition, when the carriage 12 reaches the capping position, the capping state is maintained. At this time, since the urging component 110 is unlocked, the nozzle forming surface 18*a* is securely sealed to the cap part 91 by the urging force of the urging component 110.

In addition, as illustrated in FIGS. 13A to 13C, in the case where the platen gap is large, i.e., the printing is performed to a thick sheet, the compression amount of the urging component 110 at the time of capping operation is decreased compared to the case where the platen gap as illustrated in FIG. 11 is set to an intermediate platen gap for printing to a regular sheet. When the urging component 110 is locked at the decreased compression amount and then the carriage 12 moves to the wiping position in order to perform the wiping operation, a suitable amount of interference Ywi between the wiping member 98 and the nozzle forming surface 18*a* is obtained. As a result, the wiping operation is efficiently performed. Subsequently, when the carriage 12 moves to the flushing position, an approximately constant flushing gap Yfl (for example, 3 mm) is obtained similar to the case of using the regular sheet. For this reason, since the flushing gap Yfl reaches a suitable value at the flushing period in the course of performing the printing, the discharged liquid droplets are unlikely to become mist.

According to the present embodiment described above, the following advantages are achieved.

(1) Since the gap Yfl between the recording head 18 and the cap part 91 during the flushing operation is always maintained at an approximately constant value regardless of the vertical position of the recording head 18, by setting the approximately constant gap Yfl to a distance within a predetermined range in which the discharged liquid droplets are unlikely to become mist, it is possible to efficiently prevent the liquid droplets discharged in the flushing operation from becoming mist. Therefore, it is possible to prevent contamination of the recording apparatus 10 due to the misty liquid droplets generated in the flushing operation. In addition, in the recording apparatus 10 according to the present embodiment, it is also possible to set the positional relationship between the cap part 91 and the recording head 18 during the flushing operation such that the cap part 91 makes contact with the recording head 18 in a state that the urging component 110 is expanded to the maximum length within an allowable range, (i.e., when the cap part 91 is positioned at an upper limit position of a movable range. Therefore, it is possible to set the approximately constant gap Yfl between the recording head 18 and the cap part 91 to a minimal distance that cannot be achieved by the known cleaning device. According to such an arrangement, since the liquid droplets discharged from the recording head 18 in the flushing operation are unlikely to become mist, it is possible to more efficiently prevent contamination due to the mist in the recording apparatus 10.

In addition, unlike the technology disclosed in JP-A-11-115275, in which at a cleaning time, the platen gap is changed to a platen gap different from that of a printing operation, since the platen gap adjusting operation is not required, deterioration of a throughput of the printing is prevented. In addition, even when the recording apparatus 10 includes a platen gap adjusting device 30 that is manually operated, it is possible to set both the amount of interference Ywi and the gap Yfl to an approximately constant value.

(2) Since the lowering amount of the slider 50 is set to a small value when the carriage 12 moves from the capping position to the flushing position, it is possible to set the lifting stroke amount of the slider 50 and the moving stroke amount of the slider 50 in the moving direction of the carriage 12 that determines the lifting stroke amount to a relatively small value. Accordingly, since the size of the capping unit 40 in a vertical direction as well as in the moving direction of the carriage 12 can be shortened, it is possible to downsize the cap unit 40. As the cap unit 40 becomes downsized, the recording apparatus 10 accommodating the cap unit 40 therein can be downsized.

(3) Since the amount of interference Ywi between the wiping member 98 and the recording head 18 is maintained at a constant amount during the wiping operation, the wiping performance in the wiping operation does not vary. Accordingly, it is possible to stably perform the wiping operation.

(4) In the known cleaning device, since the wiping member has to make contact with the recording head even when the platen gap has been changed, it is necessary to lengthen the wiping member in order that the wiping member makes contact with the recording head even when the platen gap has the largest gap. To the contrary, according to the present embodiment, since the amount of interference Ywi between the wiping member 98 and the recording head 18 is approximately constant, it is possible to set the wiping position of the cap head 90 to a relatively high position. Accordingly, it is possible to shorten the length of the wiping member 98. The shortened length of the wiping member 98 contributes to the reduction in the lifting stroke of the slider 50 and the cap unit 40 can be downsized by that extent.

(5) Since the urging component 110 is in an unlocked state in the course of performing the ink sucking and discharging operation, it is possible to prevent unsealing of the cap part 91 resulting from vibration generated during the ink sucking and discharging operation. Accordingly, it is possible to perform the ink sucking and discharging operation desirably.

(6) In the known cleaning device as disclosed in JP-A-2003-127434, since the amount of interference between the wiping member and the recording head has to be adjusted to a suitable value every cleaning period and the platen gap needs to be changed to a platen gap different from that of the printing operation, the throughput of the printing is deteriorated. To the contrary, according the present embodiment, since it is unnecessary to adjust the platen gap in order to adjust the amount of interference Ywi in the wiping operation, it is possible to prevent the deterioration of the throughput of the printing. In addition, according to the present embodiment, since it is unnecessary to adjust the platen gap in order to adjust the flushing gap Yfl, it is possible to prevent the throughput of the printing from deteriorating due to the flushing operation. In addition, according to the present embodiment, even when the recording apparatus 10 includes a platen gap adjusting device 30 that is manually operated, it is possible to suppress the generation of the mist in the flushing operation and set the amount of interference Ywi of the wiping member 99 to a suitable value.

The invention is not limited to the aforementioned embodiments, and the following exemplary modifications may be adopted.

Modified Embodiment 1

Although in the embodiment described above, the cap part 91 and the wiping member 93 are mounted on one slider 50, the cap part 91 and the wiping member 98 may be mounted on another element, as far as the positional relationship between the cap part 91 and the wiping member 98 is not changed, Modified Embodiment 2

Although in the embodiment described above, the cap part 91 and the wiping member 98 are held together on the slider 50, the wiping member 98 having the cap part 91 may be used in the cleaning device that does not have the cap part 91. Even when the wiping member 98 having the cap part 91 is used in the cleaning device that has the cap part 91, it is possible to attain the advantage of preventing the liquid droplets discharged in the flushing operation from becoming mist.

Modified Embodiment 3

Although in the embodiment described above, the urging component 110 is locked so as to allow the expansion and compression of the urging component 110 after the ink sucking operation is completed, the urging component 110 may be locked before the ink sucking operation is started. In this embodiment, as far as the sealing wall 92 has an elastic force that absorbs the vibration generated in the ink sucking operation and ensures the airtight sealing of cap part 91, the sealing of the cap part 91 can resist against the vibration generated in the ink sucking operation even when the urging component 110 is locked.

Modified Embodiment 4

Although in the embodiment described above, the wiping member 98 is locked to a holder (main body) constituting the cap head 90 and the ink is wiped out of the nozzle forming surface 18*a* when the carriage 12 moves, a wiper for causing the wiping member to perform the wiping operation may be mounted on the holder. For example, a wiper having a driving mechanism for causing a sliding movement of the wiping member in a direction from one end to the other end with respect to the nozzle forming surface 18*a* of the recording head 18 so as to perform the wiping operation can be used. By fixing the wiper to the holder according to the invention, it is possible to position the wiping member at a suitable vertical position. In addition, the amount of interference with respect to the nozzle forming surface can be set to a suitable value. Therefore, it is possible to attain advantages similar to those of the embodiment described above.

Modified Embodiment 5

In the embodiment described above, the cleaning operation of the cleaning device is performed on the recording head by moving the recording head toward the cleaning position (i.e., capping position (suction position), wiping position, and flushing position) located at an end of a scan area. To the contrary, it is also possible to move the cleaning device in a direction opposite to the recording head. For example, in a recording apparatus in which a head scan mechanism is not provided and a plurality of recording heads are arrayed across the entire area of the recording area (maximum printable width), a cleaning device having a moving unit which moves a cap or a wiping member in a direction opposite to the nozzle forming surface of the recording head may be used. Even when the moving cleaning device is used, since the amount of interference Ywi or the flushing gap Yfl is suitably set to an approximately constant value, it is possible to attain advantages similar to those of the embodiment described above.

Modified Embodiment 6

Although in the embodiment described above, the cleaning device having a lifting unit in which the cap head 90 mounted on the slider 50 slides upward and downward along the moving direction of the carriage by the reciprocal movement of the slider 50 is used, a cleaning device having a lifting unit raising and lowering the cap head in a perpendicular direction may be used. In other words, as far as the lifting mechanism can raise and lower the cap part, the structure of the lifting mechanism can be changed suitably.

Modified Embodiment 7

Although in the embodiment described above, the urging component 110 (urging unit) is disposed in an upper surface of the slider 50 constituting the lifting unit, the vertical position of the urging unit and the lifting unit may be reversed. In other words, the lifting unit may be supported by the urging unit in a state that the lifting unit is urged upward. For example, an arrangement in which the lifting mechanism moves in a vertical direction but not in a sliding manner and the support plate constituting the bottom portion of the vertical lifting mechanism is upward urged by the urging component (urging unit) disposed on the base body 11 may be used. In this arrangement, when the cap part is at a sealing position where the cap part makes contact with the nozzle forming surface of the recording head, by locking the urging unit at the elastically compressed state, it is always possible to position the cap part supported by the lifting part of the lifting unit at a distance within a predetermined range from the recording head during the flushing operation, regardless of the vertical position of the recording head, thereby efficiently preventing the generation of mist in the flushing operation.

Modified Embodiment 8

In the embodiment described above, the urging component 110 which includes a main body 111 having a cylindrical shape, a cylindrical movable rod 112 inserted into the main body 111 so as to partially protrude from the front end hole of the main body 111, and a coil spring 119 (spring member) embodied in the main body 111 and urged toward the protrusion of the movable rod 112, is used as the urging unit. Alternatively, the urging unit may have another structure as long as the urging unit applies an urging force that causes the sealing wall 92 and the wiping member 98 to be urged toward the nozzle forming surface 18*a*. For example, a single spring member such as a coil spring may be used as the urging unit and an elastic body such as a rubber may be used as the urging unit. In this case, a lock mechanism which engages with an locked part formed in the cap head 90 so as to cause an locking part to lock the vertical movement of the cap head 90 with respect to the slider 50 in the capping position is used as the lock unit. In addition, a structure in which the urging unit is indirectly locked by forming engagement with other component other than the cap head 90 may be used as long as it is possible to lock the urging unit. In addition, the urging unit may be in an elastically non-compressed state when the nozzle forming surface 18*a* is sealed by the sealing wall 92 of the cap head 90. For example, a tension spring may be used as the spring member and the urging unit may be locked in an expanded state.

Modified Embodiment 9

Although in the embodiment described above, the flushing operation is performed on the cap part 91, the flushing operation on the cap part 91 may be omitted. For example, an arrangement in which a receiving part for receiving liquid droplets discharged in the flushing operation is provided in the outer circumference of the printing area of the recording apparatus, the flushing operation is performed on the receiving part, and the cap part only performs a capping function (sealing function) of preventing the liquid in the nozzles of the recording head from drying and the sealing function at the time of the sucking operation may be used. In this arrangement, since a suitable amount of interference Ywi between the wiping member 98 and the nozzle forming surface 18*a* of the recording head 18 is obtained during the wiping operation, it is possible to perform the wiping operation efficiently.

Modified Embodiment 10

In the embodiment described above, the lock unit may allow the compressive deformation of the urging unit from the lock state of the urging unit while preventing the expansive deformation of the urging unit. For example, an arrangement in which a retaining member capable of moving in a vertical direction while making contact with an upper end of the urging unit so as to prevent the upward movement of the urging unit is provided and when the urging unit is elastically deformed, the retaining member is locked while making contact with the upper end of the urging unit may be used. As far as retaining member is disposed between the capping unit and the urging unit, as the capping unit is lowered while maintaining its contact with the nozzle forming surface, the capping unit is lowered together with the urging unit while being attached to the upper end of the urging unit. In this arrangement, even when the capping unit is at a low position and the gap adjusting unit shortens the gap between the liquid jet head and the medium placing surface (the platen 15), the urging unit (an urging component or an elastic body) is locked in response to the gap adjustment. In this case, since the deformation of the urging unit in a direction in which the urging unit approaches to the liquid jet head is allowed when the capping unit makes contact with the liquid jet head, it is possible to prevent the capping unit from colliding strongly with the liquid jet head during the capping operation.

Modified Embodiment 11

Although in the embodiment described above, the lock unit is electrically operated, the lock unit may be mechanically operated. An exemplary mechanical lock unit may have an arrangement in which an engagement part is formed in any one of a carriage, a lifting part as the lifting unit (the slider 50), and the capping unit, which are in the course of moving the liquid jet head to a cleaning position opposed to the cleaning device and an engaged part engaging with the engagement part is formed in the lock unit (lock mechanism). In addition, the lock mechanism may include a driving force transfer mechanism having any one of a link mechanism, a cam mechanism, and a gear mechanism, in order to cause the engagement part to engage with the engaged part so as to move the engaged part at the time of the moving operation of the carriage to the cleaning position, the lifting operation of the lifting unit, or the raising operation of the cap head. The driving force transfer mechanism converts the displacement resulting from the movement of the engaged part into the movement of the locking part capable of making engagement with locked part formed in the cap head or the urging unit (urging component). The engaged part is urged toward an unlocked state by the urging unit (such as a spring) and moves in engagement with the engagement part while resisting against the urging force of the urging unit. In this arrangement, the lock mechanism is locked when the engaged part moves in engagement with the engagement part and the lock mechanism is unlocked when the engaged part is disengaged with the engagement part.

In this embodiment, the engaged part is formed in at least one of the carriage that moves in order to move the liquid jet head to the cleaning position opposed to the cleaning device, the lifting part that is raised by the lifting unit in order to raise the capping unit, and the capping unit that is raised in order to make contact with the nozzle forming surface. In this case, when the engaged part moves in engagement with the engagement part in the course of the moving or raising operation, whereby the lock is locked and the urging unit is unlocked in an elastically compressed state. In addition, when the carriage departs from the cleaning position, the lifting part is lowered, and the capping unit is lowered, the engagement part is disengaged with the engaged part, whereby the lock mechanism is unlocked and the urging unit is unlocked in an elastically expanded state. In this manner, when the lock unit is mechanically operated, control for the locking operation which is required to perform in the electrical lock unit can be eliminated. In addition to eliminating the electric actuator that is required in the electrically operating lock unit, even when an arrangement which uses driving force of the existing electric actuator is used, it is possible to eliminate the reduction gear for transferring the driving force to the lock unit.

Modified Embodiment 12

Although in the embodiment described above, the platen gap adjusting unit is incorporated, the platen gap adjusting unit may be omitted. In general, in an inkjet recording apparatus, a number of components is disposed between the recording head 18 and the cap part in a vertical direction (a direction perpendicular to x-, y-direction in FIG. 1) and the tolerance irregularity of the gap between the recording head 18 and the cap part 91 is very large. In this embodiment, since the tolerance irregularity of the gap is absorbed without using the platen gap adjusting unit, it is possible to reduce the lowering amount of the slider 50 without considering the irregularity, compared to the known cleaning device.

Modified Embodiment 13

Although in the embodiment described above, the liquid jet apparatus is embodied in the ink jet recording apparatus 10 used for printing, the liquid jet apparatus may be embodied in a liquid jet apparatus ejecting other liquid excepting ink. Examples of the liquid jet apparatus may include a liquid jet apparatus which ejects a liquid material containing a material, such as an electrode material and a color material, in a diffused or dissolved state which is used in manufacturing liquid crystal displays, electroluminescence (EL) displays, and plane emission displays, a liquid jet apparatus which ejects a bio-organic material used in manufacturing a bio-chip, and a sample ejecting apparatus such as a precision pipette. In addition, a cleaning device including at least one of a wiping member which is incorporated into the liquid jet apparatus and wipes the nozzle forming surface of the liquid jet head and a waste liquid receiving unit which receives a waste liquid discharged from the liquid jet head in the idle discharging (flushing) operation may be applied to the invention, Modified Embodiment 14

Although in the embodiment described above, the flushing gap Yfl is set to 2 mm as an exemplary distance in which the discharged liquid droplets in the flushing operation are unlikely to become mist, the gap Yfl may be set a short distance so as to allow the gap between the nozzle forming surface 18*a* and the upper surface of the ink absorbing member in the concave part 93 of the cap part 91. By setting the gap Yfl to a minimal value, it is possible to minimize the lifting stroke amount L of the slider 50 and downsize the cap unit 40.

Hereinafter, technical features conceivable from the exemplary embodiments and the modified embodiments described above will be described.

(1) A cleaning device of a liquid jet apparatus according to the above-mentioned aspect of the invention, the device further including: a capping unit having a function of sealing a nozzle forming surface of the liquid jet head and a function of receiving waste liquid discharged from the liquid jet head; a lifting unit raising and lowering the capping unit to a sealing position and a departing position so as to attach and detach the capping unit to and from the liquid jet head; a movable part formed in a main body and disposed to be movable in a direction protruding from the main body; an elastic body urging the movable part in a direction protruding from the main body; an urging unit which is elastically deformed when the capping unit makes contact with the liquid jet head and the movable part moves in a direction opposite to the protruding direction while resisting against the urging force of the elastic body that urges the capping unit toward the liquid jet head; and a lock unit locking the movable part and the urging unit in a state that the capping unit makes contact with the liquid jet head.

(2) The cleaning device of a liquid jet apparatus according to the above-mentioned aspect of the invention and the technical feature (1), wherein the lock unit is electrically operated, and the lock unit includes an electric actuator 114 and lock mechanisms 116, 117, and 118 locking and unlocking the urging unit on the basis of the operation of the electric actuator.

In the cleaning device described above, when a predetermined time point where the capping unit makes contact with the liquid jet head is detected by a detection unit 130, the electrical actuator is operated on the basis of the detection result, the lock mechanism is locked on the basis of the operation of the electrical actuator, and the urging unit is locked. In addition, when a predetermined time point for unlocking the urging unit is detected, the electrical actuator is operated on the basis of the detection result, the lock mechanism is unlocked on the basis of the operation of the electrical actuator, and the urging unit is unlocked.

(3) The cleaning device of a liquid jet apparatus according to the above-mentioned aspect of the invention and the technical features (1) and (2), wherein the lock unit is mechanically operated, and the lock unit includes a lock mechanism having an engaged part engaging with an engagement part formed in any one of a carriage, a lifting part 50 (the lifting unit), and the capping unit, which are in the course of moving the liquid jet head to a cleaning position opposed to the cleaning device, wherein the lock mechanism is locked when the engaged part moves in engagement with the engagement part and the lock mechanism is unlocked when the engaged part is disengaged with the engagement part.

In the cleaning device described above, the engaged part is formed in at least one of the carriage that moves in order to move the liquid jet head to the cleaning position opposed to the cleaning device, the lifting part that is raised by the lifting unit in order to raise the capping unit, and the capping unit that is raised in order to make contact with the nozzle forming surface. In this case, when the engaged part moves in engagement with the engagement part in the course of the moving or raising operations whereby the lock is locked and the urging unit is unlocked. In addition, when the carriage departs from the cleaning position, the lifting part is lowered, and the capping unit is lowered, the engagement part is disengaged with the engaged part, whereby the lock mechanism is unlocked and the urging unit is unlocked In this manner, when the lock unit is mechanically operated, control for the locking operation which is required to perform in the electrical lock unit can be eliminated.

(4) The cleaning device of a liquid jet apparatus according to the above-mentioned aspect of the invention and the technical features (1) to (3), wherein the lock unit allows the deformation of the urging unit in a direction in which the urging unit approaches to the liquid jet head while preventing the deformation of the urging unit in a direction in which the urging unit departs from the liquid jet head.

In the cleaning device described above, even when the capping unit is at a low position and the gap adjusting unit shortens the gap between the liquid jet head and the medium placing surface, the urging unit is locked in response to the gap adjustments In this case, since the deformation of the urging unit in a direction in which the urging unit approaches to the liquid jet head is allowed when the capping unit makes contact with the liquid jet head, it is possible to prevent the capping unit from colliding strongly with the liquid jet head during the capping operation.

The entire disclosure of Japanese Patent Application No. 2005-243201, filed Aug. 24, 2005 is expressly incorporated by reference herein.

What is claimed is:

1. A cleaning device mounted on a liquid jet apparatus having a liquid jet head for ejecting liquid in order to clean the liquid jet head, the cleaning device comprising:

a capping unit having a function of sealing a nozzle forming surface of the liquid jet head and a function of receiving waste liquid discharged from the liquid jet head;

a lifting unit raising and lowering the capping unit so as to attach and detach the capping unit to and from the liquid jet head;

an urging unit urging the capping unit toward the liquid jet head; and a locking unit locking the urging unit in a state that the capping unit makes contact with the liquid jet head and seals the nozzle forming surface.

2. The cleaning device of claim 1, wherein the lifting unit lowers the capping unit to unseal the liquid jet head in a state in which the urging unit remains locked by the locking unit.

3. The cleaning device of claim 2, wherein a lowering amount of the capping unit is set to a preset value.

4. The cleaning device of claim 1, further comprising a head contact unit having the capping unit and a wiping member wiping the nozzle forming surface of the liquid jet head, wherein the lifting unit raises and lowers the head contact unit so as to attach and detach the capping unit to and from the liquid jet head, and wherein the lifting unit lowers by a lowering amount the head contact unit from a sealing position where the capping unit seals the nozzle forming surface to a wiping position where the wiping member wipes the nozzle forming surface, in a state in which the urging unit remains locked by the locking unit.

5. The cleaning device of claim 4, wherein the lowering amount of the head contact unit is set to a preset value in order to restrict the amount of interference between the wiping member and the nozzle forming surface at the time of wiping the nozzle forming surface to a suitably constant value.

6. The cleaning device of claim 1, further comprising a suction unit applying a negative pressure to a space where the capping unit makes contact with and seals the liquid jet head and sucking the liquid from nozzles of the liquid jet head, wherein the locking unit unlocks the urging unit when the suction unit sucks the liquid from the liquid jet head.

7. The cleaning device of claim 1, wherein when the liquid jet head is idling without ejecting the liquid, the lifting unit raises the capping unit and the lifting unit caps the nozzle forming surface by making contact with and sealing the nozzle forming surface in order to prevent the liquid in nozzles of the liquid jet head from drying and the locking unit unlocks the urging unit when the nozzle forming surface is capped by the capping unit.

8. The cleaning device of claim 1, wherein the locking unit unlocks the urging unit before the lifting unit raises the capping unit and makes contact with the liquid jet head.

9. The cleaning device of claim 1, wherein the locking unit unlocks the urging unit for a capping period when the lifting unit raises the capping unit.

10. The cleaning device of claim 1, wherein when the liquid jet head ejects the liquid onto a medium, the urging unit is locked by the locking unit, the liquid jet head performs a flushing operation in a state that the liquid jet head faces the capping unit for a flushing period in the course of ejecting the liquid, and the locking unit still locks the urging unit during the flushing operation.

11. The cleaning device of claim 1, wherein the liquid jet apparatus comprises a gap control unit which moves the liquid jet head in order to control the gap between the liquid jet head and a surface of a medium having the liquid from the liquid jet head deposited thereon, and the cleaning device is mounted on the liquid jet apparatus.

12. A liquid jet apparatus comprising a liquid jet head for ejecting liquid and the cleaning device of claim 1.

13. A cleaning method of a liquid jet apparatus in which a capping unit makes contact with and seals a nozzle forming surface in order to prevent liquid in nozzles of a liquid jet head for ejecting the liquid from drying and the capping unit opposing the nozzle forming surface with a gap therebetween receives waste liquid discharged from the nozzles of the liquid jet head, the method comprising:

sealing the nozzle forming surface by raising the capping unit to make contact with the liquid jet head in order to prevent the liquid in the nozzles of the liquid jet head for ejecting liquid from drying;

locking an urging unit, which urges the capping unit in a sealing state toward the liquid jet head, in a state that the capping unit makes contact with the liquid jet head and seals the nozzle forming surface;

lowering the capping unit from a position where the capping unit makes contact with the liquid jet head to a flushing position where the capping unit receives the waste liquid discharged from the liquid jet head; and flushing the waste liquid out of the liquid jet head toward the capping unit at the flushing position.

* * * * *